United States Patent [19]

Carver, Jr. et al.

[11] 4,075,815

[45] Feb. 28, 1978

[54] AUTOMATIC PACKAGE WRAPPING MACHINE

[75] Inventors: Herbert K. Carver, Jr., Cornwells Heights; Albert H. Chant, Holland; James F. Hall, Ardsley; Omar Hansen, Jr., Yardley; John G. Lord, Swarthmore, all of Pa.

[73] Assignee: Franklin Electric Subsidiaries, Inc., Fallsington, Pa.

[21] Appl. No.: 681,828

[22] Filed: Apr. 30, 1976

[51] Int. Cl.[2] ..... B65B 11/26

[52] U.S. Cl. ..... 53/32; 53/74; 53/228

[58] Field of Search ..... 53/32, 74, 76, 182 R, 53/228, 229, 230, 33

[56] References Cited

U.S. PATENT DOCUMENTS

| | | | |
|---|---|---|---|
| 2,894,363 | 7/1959 | Voogd | 53/228 |
| 3,150,475 | 9/1964 | Schooler | 53/228 X |
| 3,307,326 | 3/1967 | Krebs | 53/228 X |
| 3,488,912 | 1/1970 | Christian | 53/182 R X |
| 3,503,175 | 3/1970 | Marasso et al. | 53/182 X |
| 3,513,622 | 5/1970 | Timmerbeil | 53/229 X |
| 3,816,969 | 6/1974 | Zimmerman | 53/210 X |
| 3,910,005 | 10/1975 | Thimon et al. | 53/210 X |

*Primary Examiner*—Othell M. Simpson
*Assistant Examiner*—John Sipos
*Attorney, Agent, or Firm*—Paul & Paul

[57] ABSTRACT

A method of, and apparatus for, wrapping packages of different sizes in thin-gage film and heat sealing the film includes transporting the package at the same horizontal level through the machine, pulling the film down across a horizontal in-line package path to form a vertical wall of film, pushing the article along the path forwardly into the wall of film, forming a tubular loop of film about the package with the loop open at the rearward end, severing the film, closing and sealing the rearward end of the loop, stretching, and/or underfolding the film, and heat sealing the package. The length of film needed to wrap packages of randomly different sizes is sensed and fed automatically. A trailing-end portion of over-lapping film of preselected fixed length, irrespective of the size of the particular package, is provided at the rearward edge of the package. This over-lapping trailing portion is heat sealed and then pushed against the back of, or under, the package.

32 Claims, 21 Drawing Figures

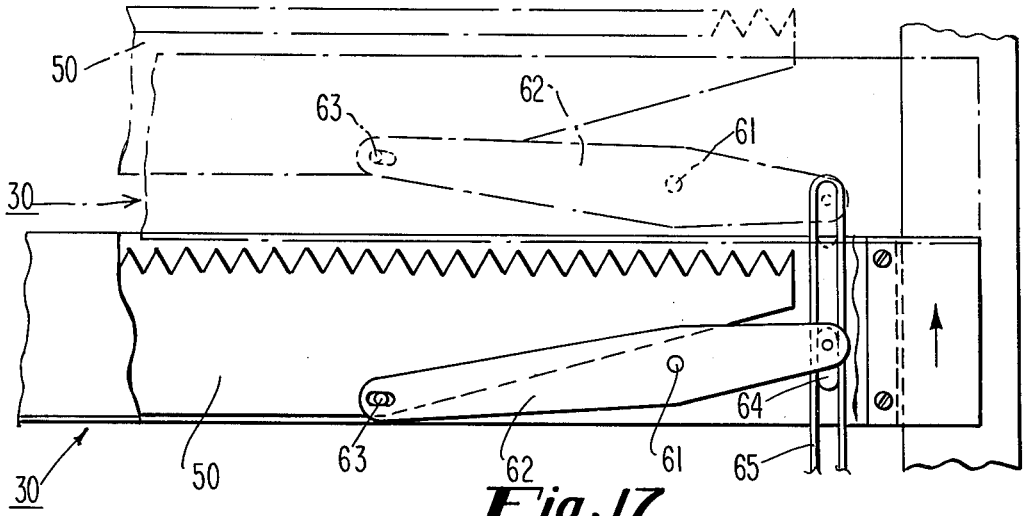
Fig. 17
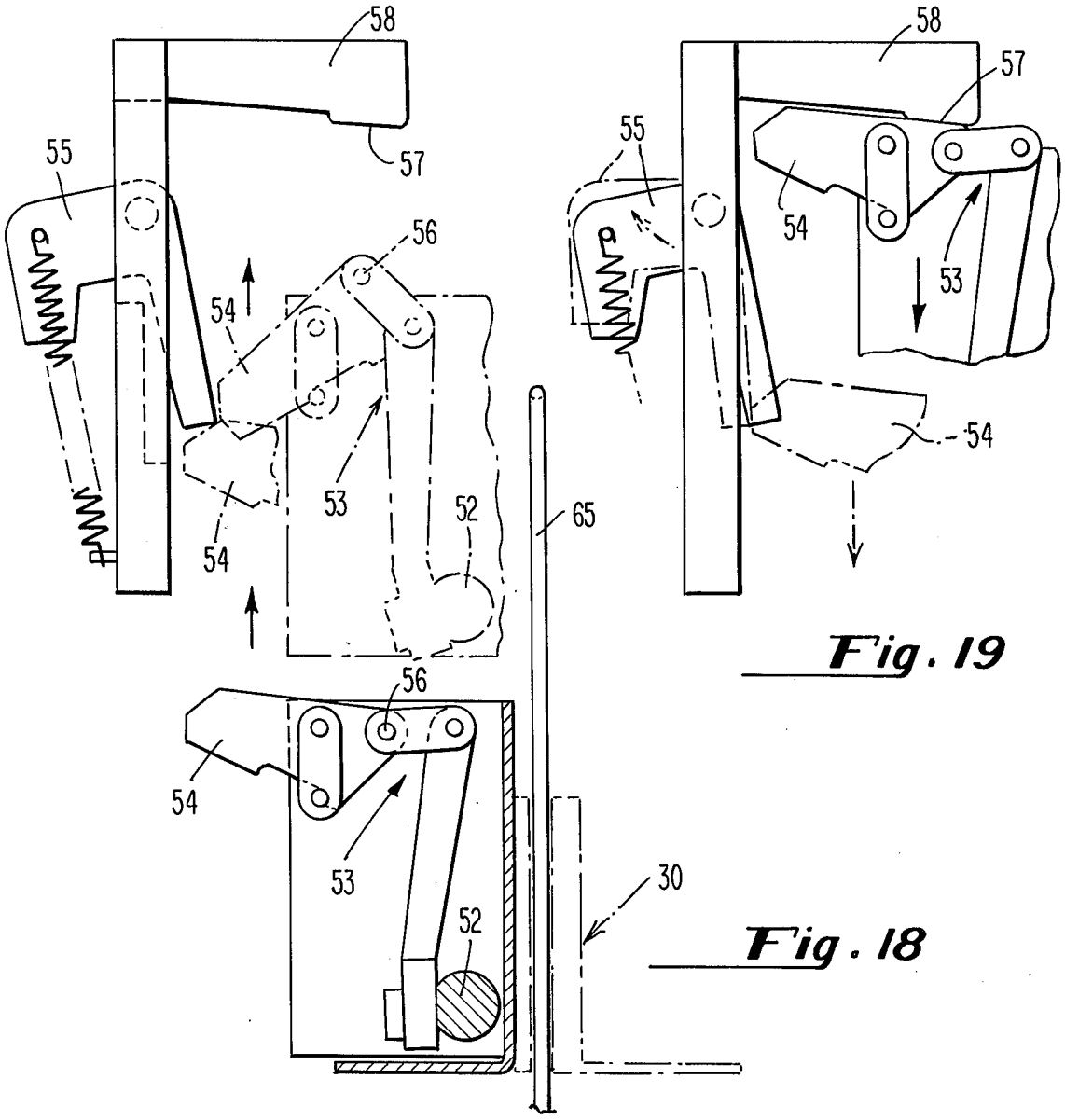
Fig. 19
Fig. 18

AUTOMATIC PACKAGE WRAPPING MACHINE

BACKGROUND OF THE INVENTION

This invention relates to a method of, and apparatus for, wrapping articles in heat-sealable thin-gage film such as plastic.

While the method and apparatus of the present invention may be used for wrapping other articles, a typical article is a tray containing a meat product, as for example, lamb chops, chicken breasts, ground meat, steak, etc. After wrapping, the packages ultimately are placed for sale in the refrigerated display areas of stores, such as supermarkets. The articles referred to are typically wrapped in the cold rooms of supermarkets and central packaging plants, and the prior art has provided two basic types of apparatus for such wrapping. One type is a manual wrapping machine which is used to assist the operator in manual wrapping of the package. The second type is a fully automatic machine which receives the article, then proceeds to wrap and heat seal the package and to deliver the same, as to a conveyor belt. The present invention relates to the second type of machine, i.e., the fully automatic machine.

In one known prior-art automatic wrapping machine (Zimmerman U.S. Pat. No. 3,816,969) the article being wrapped is lifted from one level to another, and also reverses its direction of movement, during the wrapping sequence. In the machine of the present invention the article travels along a straight in-line horizontal path. In the Zimmerman patent, the article is pushed into a vertical wall of film. This is also done in the method and apparatus of the present application. However, in Zimmerman the trailing length of upper film is trucked under the package by raising the level and then reversing the direction of travel of the package. This is not done in the machine of the present application, and faster operation is possible.

In another prior-art patent (Holt, U.S. Pat. No. 3,659,398) the package follows a straight in-line path but the film is taken from a pre-cut or pre-sheeted supply and the upper film is formed by a forward overwrap movement. In the machine of the present application, the upper film is formed by rearward overwrap while the package is moving forwardly.

SUMMARY OF THE PRESENT INVENTION

A general object of the present invention is to provide an automatic package wrapping machine having features not found in prior art machines.

A more specific object is to provide an automatic package wrapping machine in which the package travels along a straight in-line horizontal path through the machine, thereby to permit faster operation.

Another object is to provide an automatic package wrapping machine in which the package moves in a straight in-line horizontal path and in which the length of film needed to wrap articles of randomly different sizes is sensed and fed automatically.

Another object is to provide an automatic package wrapping machine having the above-mentioned features in which the conveyor or transport portions of the machine may be allowed to continue to run without actuating the film-wrapping mechanisms until the need therefor is sensed by a package-sensing mechanism.

Another object is to provide a machine having the foregoing features in which the article is wrapped in tubular fashion using a rearward overlap while the package is moving forwardly.

Another object is to provide a machine having the foregoing features in which the rearward edge of the package functions as the reference point for controlling the length of film which forms a trailing tail at the rear edge of the package, and which is heat sealed to form an open-ended tubular loop about the package, the open ends of which are subsequently folded under and sealed.

Another object is to provide a machine having the foregoing features in which the length of the tail at the rearward edge of the package is preselected, and fixed automatically irrespective of the length and height of the package.

Yet another object is to provide a machine having the foregoing features and having, in addition, provision for a plurality of supply rolls of the same or different widths, with means for conveniently changing from one width to another.

BRIEF DESCRIPTION OF THE DRAWINGS

FIG. 17 is a detailed view of the shear-blade actuating mechanism.

FIG. 18 is a detailed view illustrating the action of the lap-adjuster gripper mechanism looking along the line 18—18 of FIG. 13.

FIG. 19 is a view of a portion of FIG. 18.

DETAILED DESCRIPTION OF THE DRAWINGS

Reference will first be made to FIGS. 1 through 6 which is a series of sequential schematic representations illustrating the general operation of the machine of the present invention and the method used to wrap the article in thin-gage film to form the package. Although strictly speaking the article to be wrapped, or being wrapped, does not become a package until after it is wrapped, it will be convenient to refer to the article as the package, and this term will be used interchangeably with the term article to mean the same thing.

Figure 1:
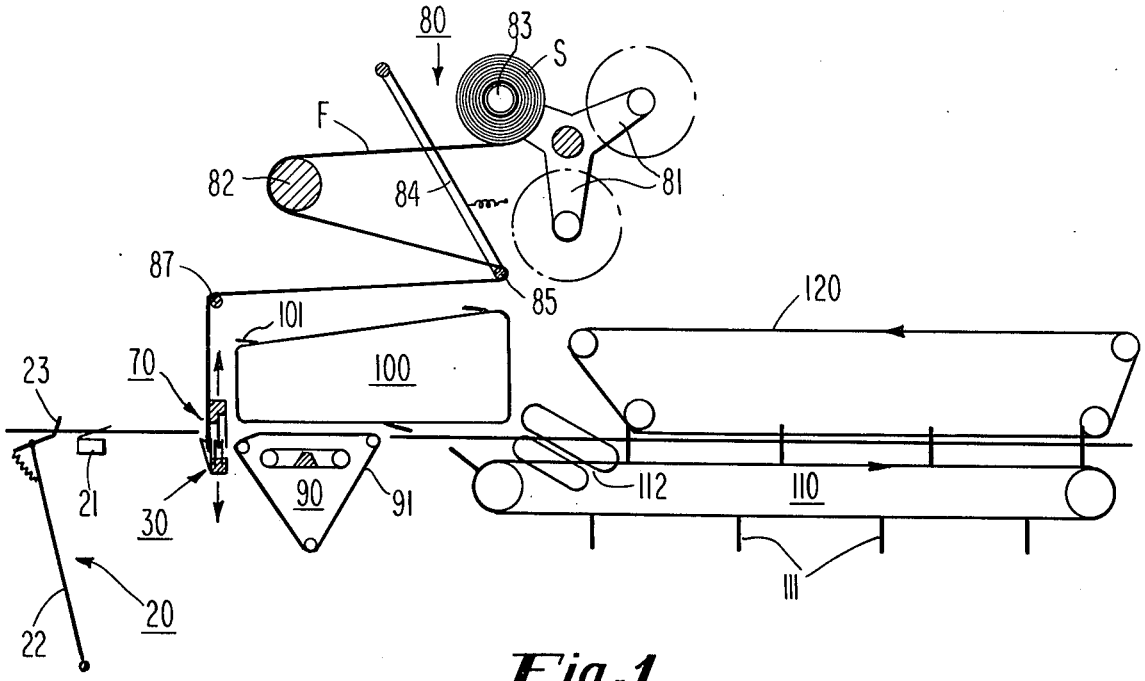
FIGS. 1 through **6*b*** is a series of sequential schematic illustrations showing how the article is wrapped automatically by the method and machine of the present invention.
Figure 2:
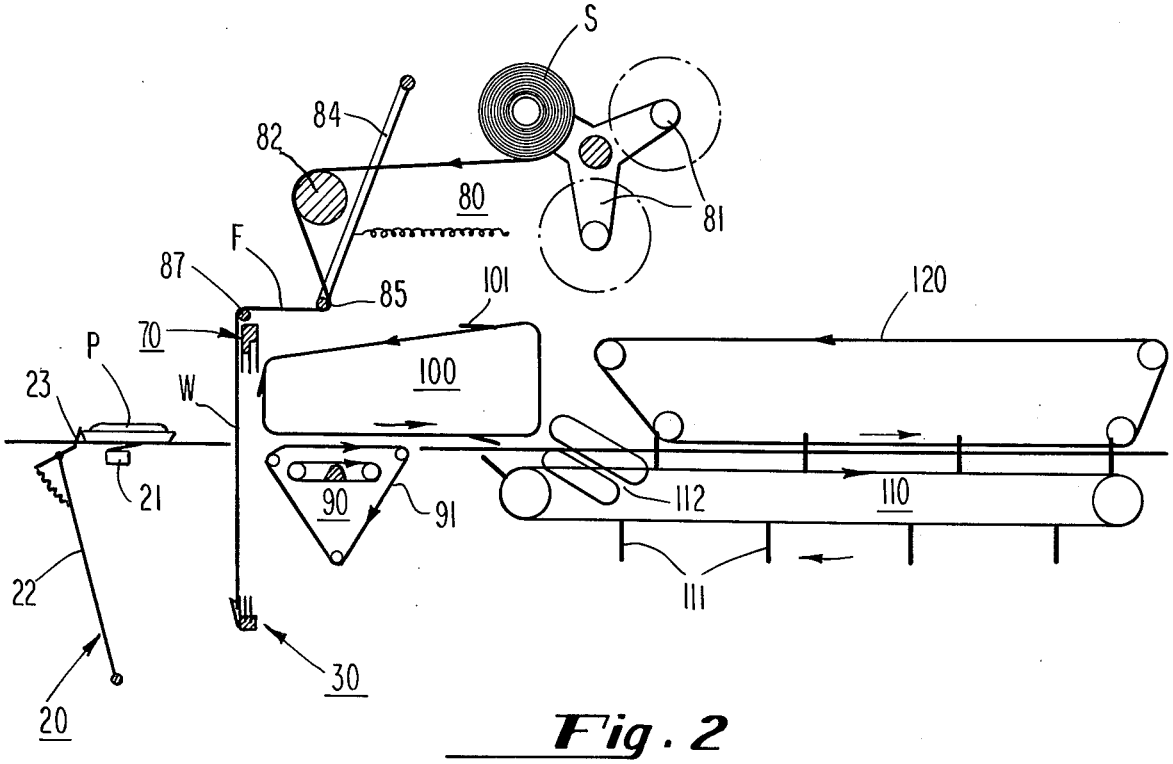
Figure 3:
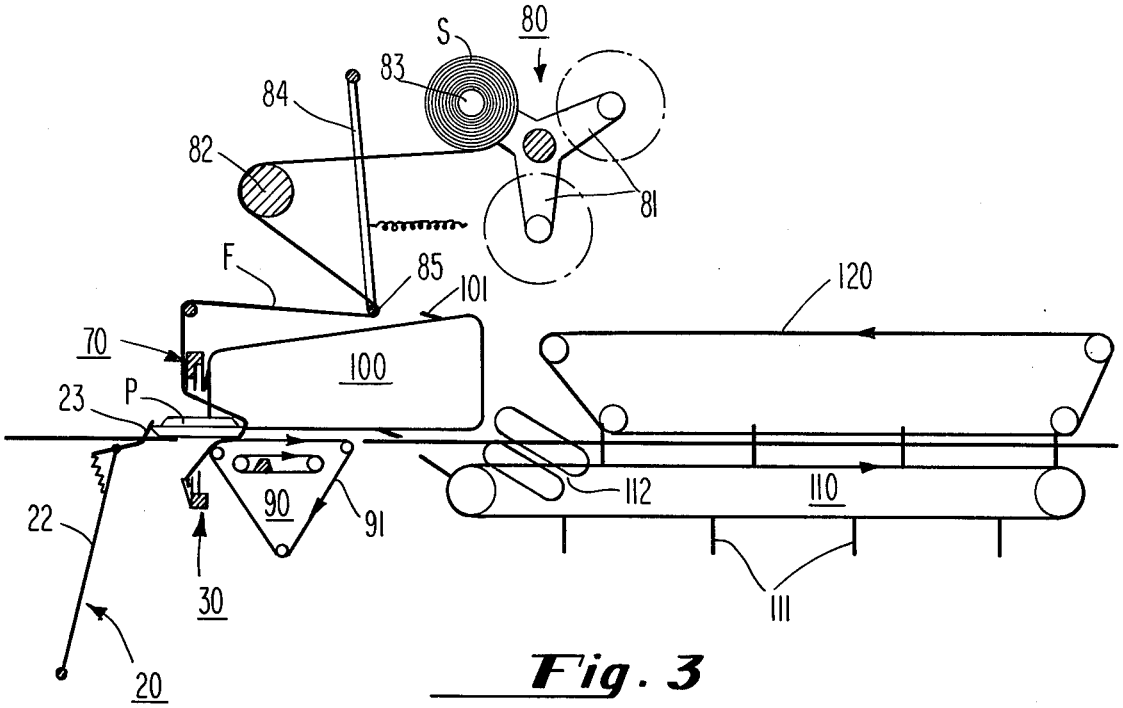

In FIGS. 1 – 6, the article or package to be wrapped is identified as P. Its direction of travel is from left to right. The package in-feed mechanism is identified generally by the reference numeral 20. The lap-adjuster mechanism is identified generally by the reference numeral 30. This mechanism controls the length of the overlap at the trailing or rearward edge of the package. The bight carrier mechanism is identified generally by the reference numeral 70. This mechanism forms the upper side of the loop of film about the package, as illustrated in FIG. 3. The film-supply mechanism is identified generally by the reference numeral 80. This mechanism senses the need for additional film from the film supply and delivers the amount needed. The cross-seal heater mechanism is identified generally by the reference numeral 90. This mechanism heat seals the trailing lap portion. The first transport mechanism is identified generally by the reference numeral 100. The second transport mechanism is identified generally by the reference numeral 110.

The power switch actuates the heaters.

Figure 20:
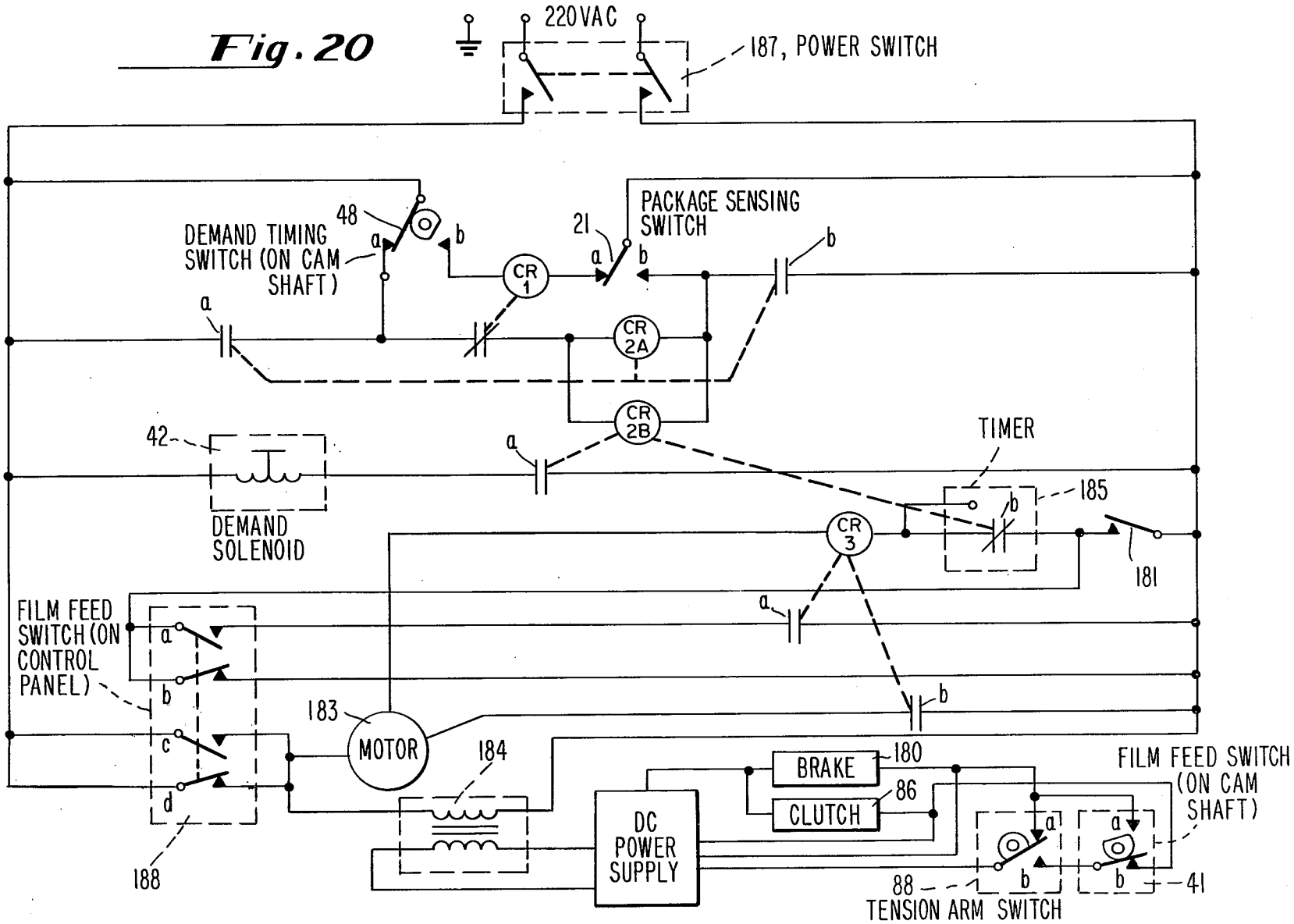
FIG. 20 is a schematic drawing of pertinent portions of the electrical circuitry.

The machine is turned ON by the start switch 181 seen in FIG. 20. This actuates the conveyor system, including the first and second transports. But the in-feed, lap adjuster, and bight carrier remain immobile.

The function of the package in-feed mechanism 20 is to receive the package P which may be manually or otherwise deposited thereon, and, in response to sensing the receipt of the package, to trigger the film-wrapping portions of the automatic wrapping machine into one cycle of operation.

The lap-adjuster mechanism 30 in its start position, seen in FIG. 1, is holding the end of the web of film. Its function, in response to the deposit of a package on the in-feed mechanism, is to pull the film vertically downwardly across the horizontal in-line package path to form a wall of film, and then, as the package is pushed toward the wall of film, to lift the end of the film at a rate coordinated with the forward movement of the article toward the film, thereby to control the formation of the underportion of the loop of film about the article, and to control the length of the lap portion trailing behind the article.

The function of the bight carrier 70 is to form the upper portion of the loop of film about the article, and in cooperation with the lap-adjuster to sever the film, and position the resulting end into the lap-adjuster grippers.

The function of the film-supply mechanism 80 is to sense the length of film needed for wrapping the article. The automatic mechanism of the present invention is adapted to receive, at random, articles of different sizes, i.e. of different lengths and of different heights. The width of film needed is taken care of by manual selection, specifically by rotating a multi-arbor turret to bring into film-feeding position the roll of film having the desired width. The function of the film-supply mechanism 80 provided by the present invention is to provide that length of film which is needed to wrap, without excess and without waste, the particular article which at that moment is passing through the machine.

Figure 5:
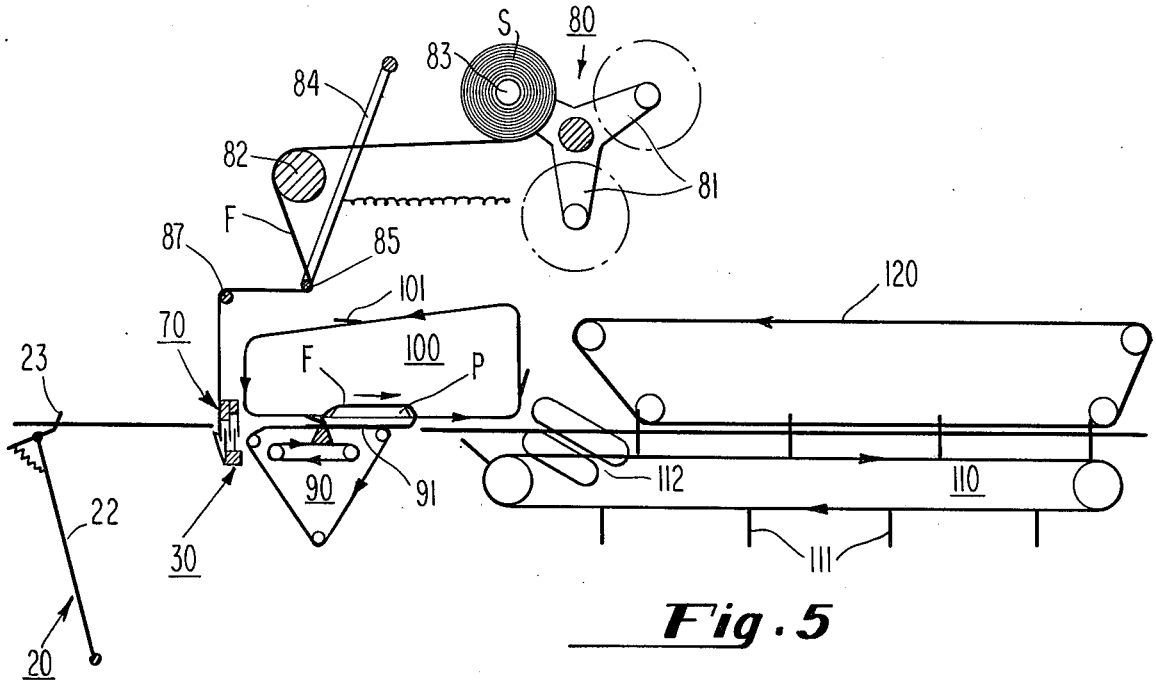

The function of the cross-seal heater 90 is to seal the film at the trailing lap portions, as illustrated in FIG. 5.

The function of the first transport 100 is to receive the article from the in-feed mechanism 20 and to push it forwardly toward the delivery or discharge end of the machine. The first transport mechanism also functions to close the loop of film about the article at the rearward end thereof. In this specification, the terms "forward" and "rearward" are used in relationship to the direction of travel of the package through the machine. Thus, the in-feed mechanism is at the rearward end of the machine, and the package moves forwardly.

The function of the second transport mechanism 110 is to receive the tubularly-wrapped package from the first transport mechanism 100 and to carry the article forwardly toward the discharge end of the machine. The second transport mechanism 110 also functions to stretch and/or fold the opposite ends of the tubularly wrapped package and to complete the heat sealing of the package by transporting the package over bottom heat sealers.

FIG. 1 illustrates schematically the positions of the various component parts of the machine before an article or package has been placed on the package sensor 21. Before a package has been placed in the machine, the lap-adjuster mechanism 30 is in its UP position, at the level of the horizontal in-line path the package is to follow. The bight-carrier mechanism 70 is in its DOWN position, intermeshed with the lap adjuster. The spring-loaded film-sensor roller 85 and supporting rods 84 are in their forward spring-biased position.

Referring now to FIG. 2, when a package P is placed on the in-feed mechanism, the presence of the package is sensed by the package-sensor switch 21, and in response thereto the film-end-holding lap adjuster 30 moves downwardly from the package-path level to its lowermost position, the loop-forming bight carrier 70 moves upwardly from the package-path level to its uppermost position, and the in-feed package pusher starts forwardly. The distance from the end of the film F held by the lap adjuster 30 when in its lowermost position (FIG. 2) to the level of the package path, and the rate of upward travel of the lap adjuster are, according to the present invention, carefully related to the distance from the film wall W to the fingers 23 of the in-feed pusher 22 and to the rate of forward travel of the in-feed pusher so that the lap adjuster arrives at the level of the package path a preselected fixed distance after the rearward edge of the package reaches the location of the film wall W. For example, if the machine is built for a maximum expected length package of 12 inches, the distance from the in-feed pusher 23 to the wall W, the starting time forward of the in-feed pusher, and its rate of travel may be so related to the distance from the package path to the lower end of the film held by the lap adjuster in its lowermost limit, its starting time upward, and its rate of travel, as to provide a trailing lap of 2 inches. This trailing lap of 2 inches would be provided by that machine irrespective of the length of any particular package which is placed into the machine. Moreover, it is not necessary that the package be placed at a precise position at the in-feed. Any position is acceptable so long as the sensing switch is able to sense the presence of the package.

Referring again to FIG. 2, when in response to sensing a package at the in-feed positions the end of the film F is pulled down by the lap adjuster 30, no additional film is delivered from the supply roll S. This is because a film-feed timing switch controlled by the cam shaft of the machine, as will later be described, is not in closed position at this time in the cycle. As a result, the film sensor roller 85 is pulled rearwardly against the force of its biasing spring, into a position such as is illustrated in FIG. 2. Roll 82 is the power driven film pull-off roller. Roll 87 is a fixed guide roll.

The film-end-holding lap adjuster 30, the loop-forming bight carrier 70, and the in-feed pusher 22, are all cam actuated from a common cam shaft. These cams control the starting times and rates of travel of the three components just mentioned. One revolution of the common cam shaft corresponds to one cycle of operation. Since the fingers 23 push against the rearward edge of the package, it is evident that by controlling the time of arrival of the fingers 23 at the film curtain or wall, relative to the times of arrival of the lap adjuster and bight carrier, that the time of arrival of the rearward edge of the package, relative to the end of the film, is also controlled.

Referring now to FIG. 3, it will be seen that if, during the first portion of the upward movement of the lap adjuster 30, the package P has not yet reached the film wall W, the roll 85 will swing to the right to take up the slack. The extent to which the roll 85 moves to the right is a function of the time instant that the front edge of the package engages the film wall. This in turn is a function of the length of the package P. It will be seen, for example, that if the package P has a short length, such as 4 inches, upward movement of the lap adjuster 30 while the pusher 22 is moving forward will tend to put considerable slack in the wall of film before the front edge of the package P even reaches the film wall. This slack is taken up by the spring-loaded movement of roll 85 to the right. It should also be noted that the instant at which the front edge of a 4-inch package will first engage the film wall is independent of the particular position in which the package is placed at the in-feed position, provided, of course, that it is placed in a position which can be sensed by the switch 21. The film extending between the lap adjuster and the front edge of the package forms, of course, the under portion of the loop about the package.

Continuing to look at the schematic illustration of FIG. 3, it will be seen that as the bight carrier 70 moves downwardly, it forms the upper portion of the loop about the package P. If the package P is of sufficient length, and/or of sufficient height, the downward pull of the film F by the bight carrier 70 will pull the film-sensing roller 85 to the left, and at a selected point the arm of film-feed switch 88 (FIGS. 7 and 20) will switch positions, an electrical circuit will be completed, a clutch on film pull-off roll 82 will be energized, a clutch on the arbor of supply roll S will be de-energized to release the brake and additional film will be delivered from the supply S.

As already indicated, the machine of the present invention is designed to package articles of different sizes placed at random at the input end of the machine. For example, a tray containing 2 lamb chops may be relatively short in length and small in height, while a tray containing a roast may be of substantially greater height and length. An important feature of the present invention is that of supplying automatically that length of film which is needed to wrap a particular tray, without film waste.

Figure 4:
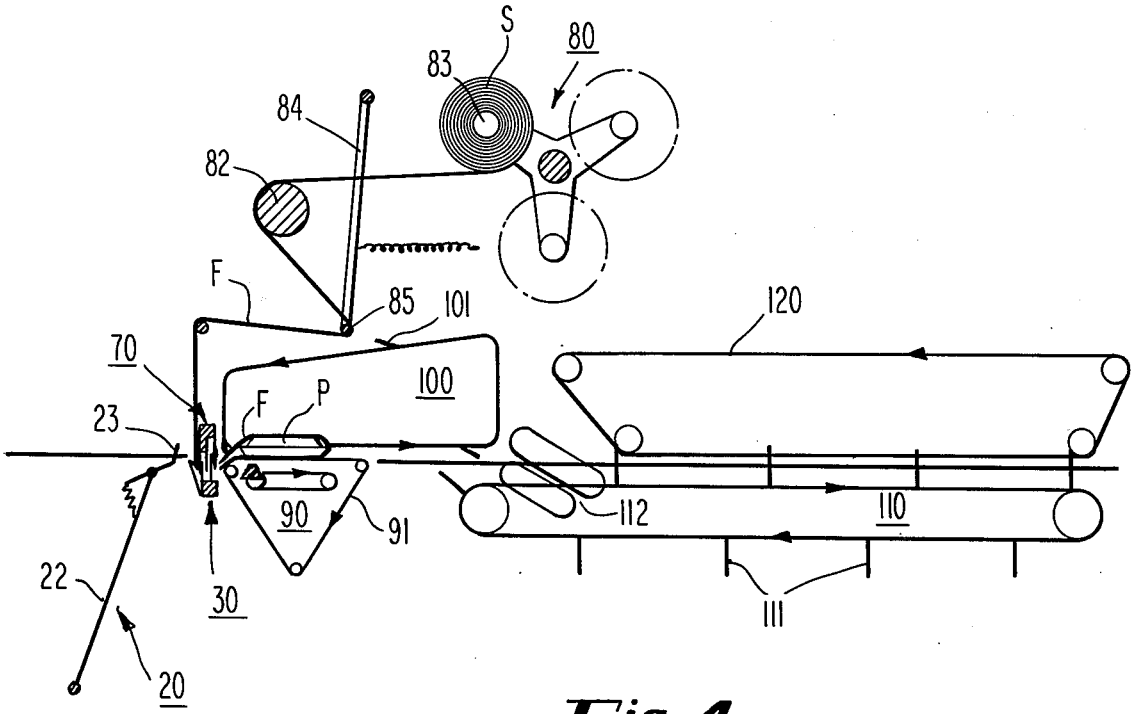

In FIG. 4, the lap-adjuster 30 is at the upper limit of its stroke, and the bight carrier 70 is at the lower limit of its stroke. In these positions, the lap-adjuster and bight carrier became intermeshed. During the intermeshing, the film on the upper portion of the loop which has now formed about the package, is severed and the new end of film is gripped by the lap adjuster, ready to be pulled downwardly on the next cycle to provide a wall of film for the next package. Severing of the upper film forms a trailing portion which trails behind the tray or article and which overlaps the tail or lap of the under portion. The length of this tail is fixed irrespective of the length or height of the package which has just been wrapped. This overlapping trailing portion is heat sealed by the cross-seal heater 90 and the first transport 100 which make contact with the film at the rearward end of the package and move along forwardly in timed relationship with each other. This is illustrated in FIG. 5.

Figure 6A:
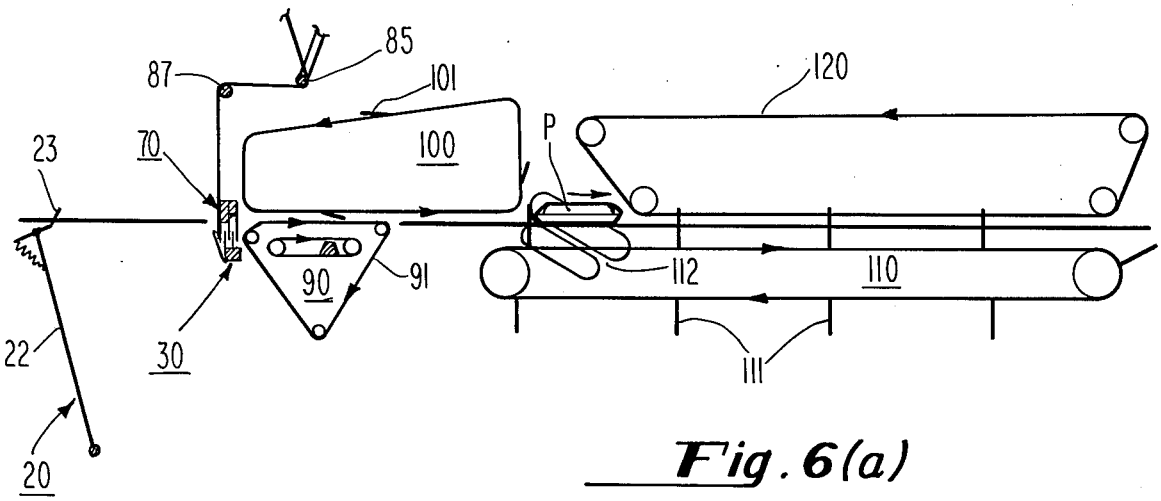
Figure 6B:
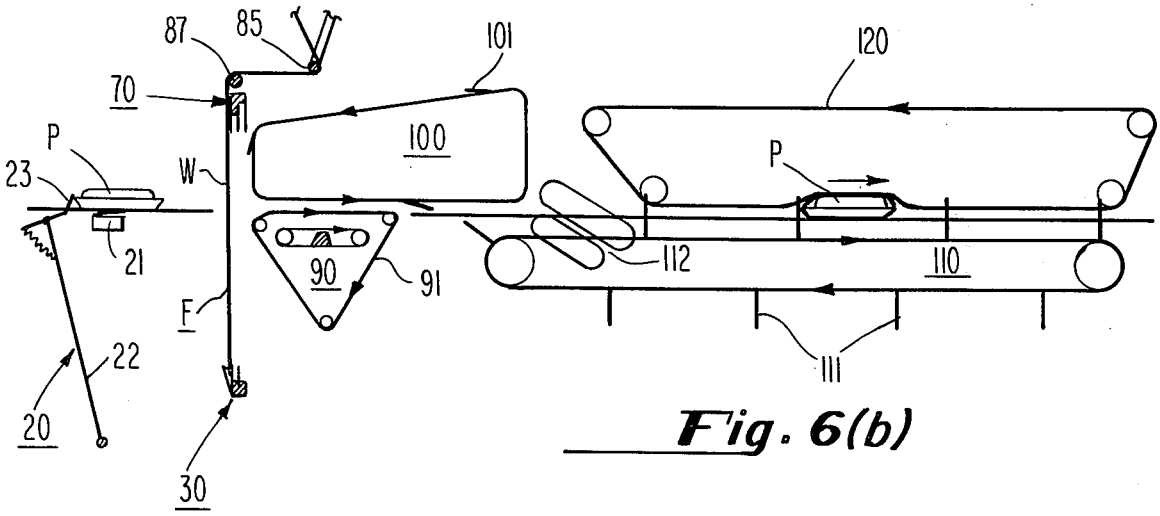

In FIG. 6(*a*) the package has been delivered by the first transport 100 to the second transport 110. In transport 110, the heat-sealed trailing portion is pushed forwardly against or under the package, the outwardly-extending ends of the tubularly wrapped package are stretched and pulled downwardly as by downwardly-and-forwardly inclined gripper chains 112, are then folded onto the underside of the package, and then heat sealed. A pressure belt 120 exerts downward pressure on the package as it is carried along by the transport mechanism 110. This is illustrated in FIG. 6(*b*).

Figure 7:
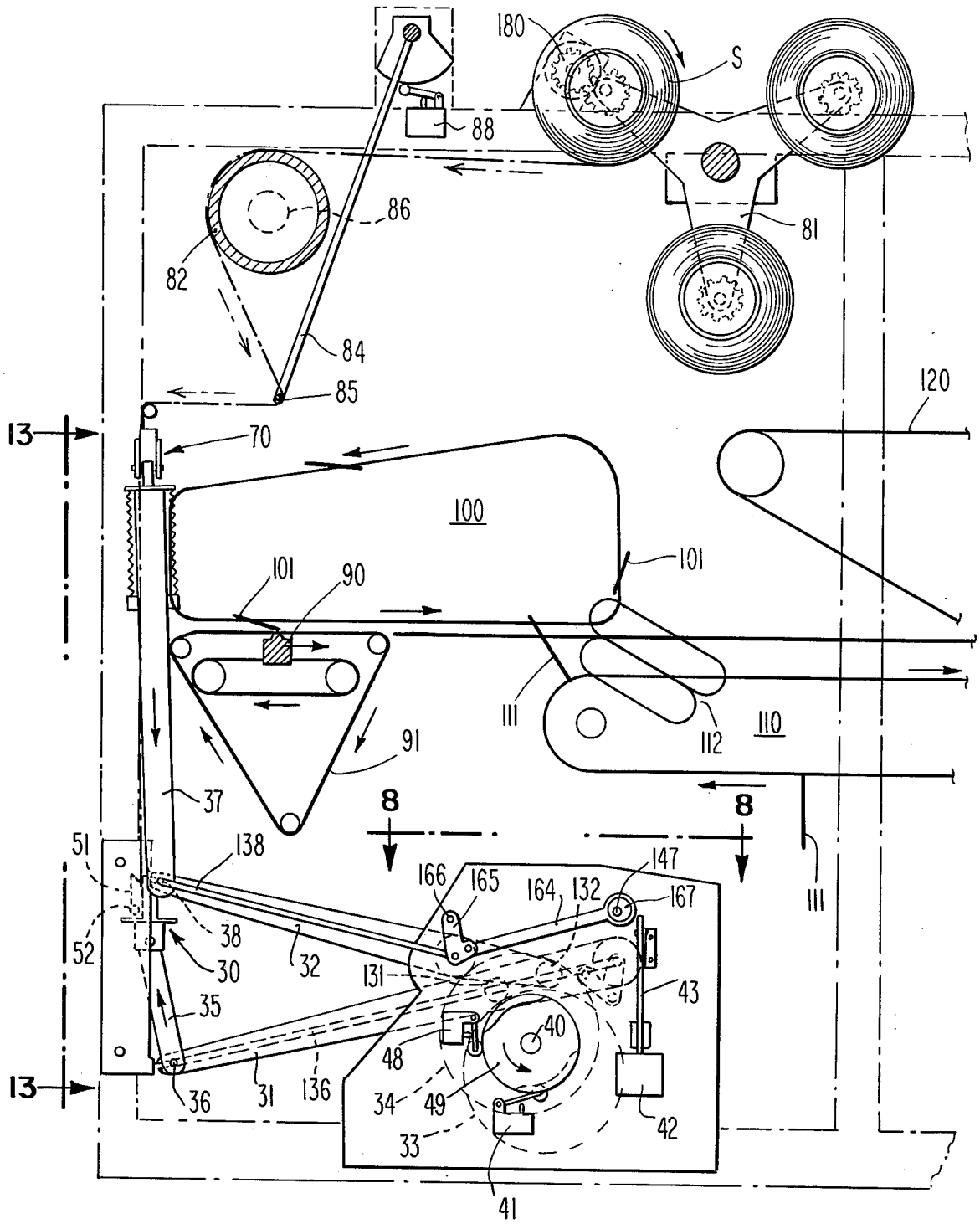
FIG. 7 is a side elevational view, partially schematic, showing a portion of the wrapping machine.

In FIG. 7, are seen the means by which the lap-adjuster 30 is moved cyclically down and up, and the means by which the bight-carrier is moved cyclically up and down. These movements are accomplished by a pair of cam-follower arms 31 and 32 on each side of the machine. In FIG. 7, arm 31 is the follower arm which accomplishes down and up cyclical movement of the lap adjuster. Arm 32 is the follower arm which accomplishes up and down movement of the bight carrier. When the start switch (FIG. 20) is pressed, the cam shaft 40 is actuated and the two followers arms 31 and 32 are driven cyclically up and down in out of phase relationship by the cams 33 and 34 respectively. The lap-adjuster follower arm 31 is connectable to a connecting link 35 through a pin 36 by actuation of a linkage 136. The bight-carrier follower arm 32 is connectable to a connecting link 37 by a pin 38 by actuation of a linkage 138. However, unless a package has been placed at the input end of the machine and sensed by the package sensor 21, the linkages 136 and 138 are not actuated and the follower arms 31 and 32 are not connected to the connecting links 35 and 37. Until a package is sensed, these two follower arms 31, 32, merely move up and down, without being connected to, and without driving, the bight carrier and lap-adjuster. In similar manner, and by similar means, linkage from an in-feed cam 24 on the common cam shaft 40 (FIGS. 8 and 9) moves back and forth without being connected to the in-feed pivot arm 22. Such connection is not made until a package is sensed at the in-feed position.

Figure 9:
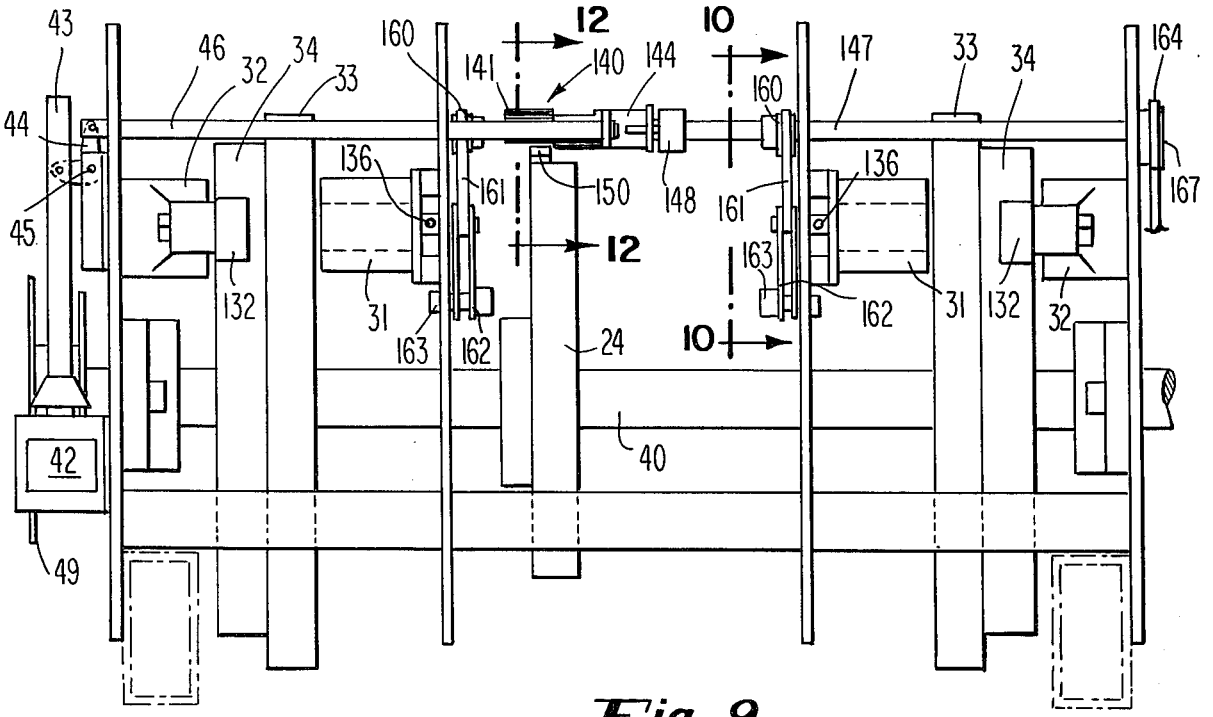
FIG. 9 is a elevational view of the cam shaft, eccentric, and shift mechanisms, looking along the line 9—9 of FIG. 8.

When a package P is placed on the package sensor 21, and provided that a demand timing switch operated by a cam on the common cam shaft is closed, an electrical circuit is completed which energizes a solenoid 42 seen in FIGS. 7 and 9. By means later to be described in detail, energization of the solenoid 42, through a shift and eccentric mechanism later to be described, is effective, during dwell periods of cam 33 and 34, of connecting the lap-adjuster follower arm 31 to the connecting link 35, and of connecting the bight-carrier follow arm 32 to the connecting link 37. This is achieved through the linkages 136 and 138, respectively. These linkages are actuated when the lap adjuster and bight carrier are together in intermeshed relationship, i.e., when the lap adjuster is in its UP position and the bight carrier is in its DOWN position. While these are not the positions of the lap adjuster and bight carrier illustrated in FIG. 7, nevertheless, FIG. 7 will serve to show that when linkage 136 is moved to the right it will pull link 35 to the right, thereby pulling pin 36 into the notch of the bifurcated end of arm 31. Similarily, movement of linkage 138 to the right will pull link 37 to the right, thereby pulling pin 38 into the notch of the bifurcated end of arm 32. After these connections have been made, the cyclical down and up movement of arm 31, and the cyclical up and down movement of arm 32 will drive the lap adjuster and bight carrier in corresponding fashion. Connection of a cam-follower arm to linkage to the in-feed pivot arm 22 is made in similar manner.

Referring now to FIGS. 1 and 7, in the condition illustrated schematically in FIG. 1, with no package at the in-feed position, the lap adjuster 30 and the bight carrier 70 are in intermeshed relationship at the level of the package path. In this condition, the follower arms 31 and 32 are not connected to the linkage 35 and 37 and, assuming the machine is running, the arms 31 and 32 are merely going cyclically up and down driven by cams 33 and 34. When a package P is placed on the package sensor 21, (or shortly thereafter, if the time instant in the cam cycle is such that the cam operated demand timing switch 48 shown in FIG. 7, whose function will be explained later, is open) solenoid 42 is energized, and at the dwell periods on cams 33,34, and by means later to be described, the linkages 136 and 138 are retracted and the pins 36 and 38 are pulled into the notches of the follower arms 31 and 32. As previously mentioned, this action takes place when lap-adjuster follower arm 31 is in its up position and bight-carrier follower arm 32 is in its down position. Thereafter, the lap-adjuster 30 will be moved downwardly, and the bight carrier 70 will be moved upwardly, to the positions illustrated schematically in FIG. 2, thereby forming the vertical curtain or wall W of film across the package path. When the end of the film is pulled down by the lap adjuster 30, the film-sensing roller 85 at the lower ends of the arms 84 is pulled to the left, from the position indicated in FIG. 1 to the position indicated in FIG. 2. When this happens the switch arm of the film-feed switch 88 (FIGS. 7 and 20) moves to contact '*b*' but the cam-operated timing switch 41 operated by a cam 49 on the common cam shaft 40, is still at contact '*a*'. Consequently, the electrical circuit to the clutch 180 on the supply film arbor 83 remains closed, and the circuit to the drive clutch 86 which control the chain drive to the film pull-off roller 82, remains open. Thus, the drive clutch 86 is not energized, and the film pull-off roll 82 is not driven.

When the deposit of a package at the in-feed is sensed, an in-feed cam follower arm (not shown) driven by in-feed cam 24, is connected to linkage to the in-feed pusher arm 22 by the in-feed eccentric 122 and at a time instant controlled by in-feed cam 24, the in-feed lever 22 is pulled forwardly and either instantly or in due course depending upon the position of the article deposited, the pusher fingers 23 engage the rearward edge of the package and push the package P forwardly toward the wall of film. About this time, the lap adjuster 30 starts to move upwardly from its FIG. 2 position, being driven by the lap-adjuster follower arm 31 and the connecting link 35, under the control of cam 33. At a later time, the bight carrier 70 starts to move downwardly from its FIG. 2 position, being driven by the bight-follower arm 32 and the connecting link 37, under the control of cam 34.

Figure 13:
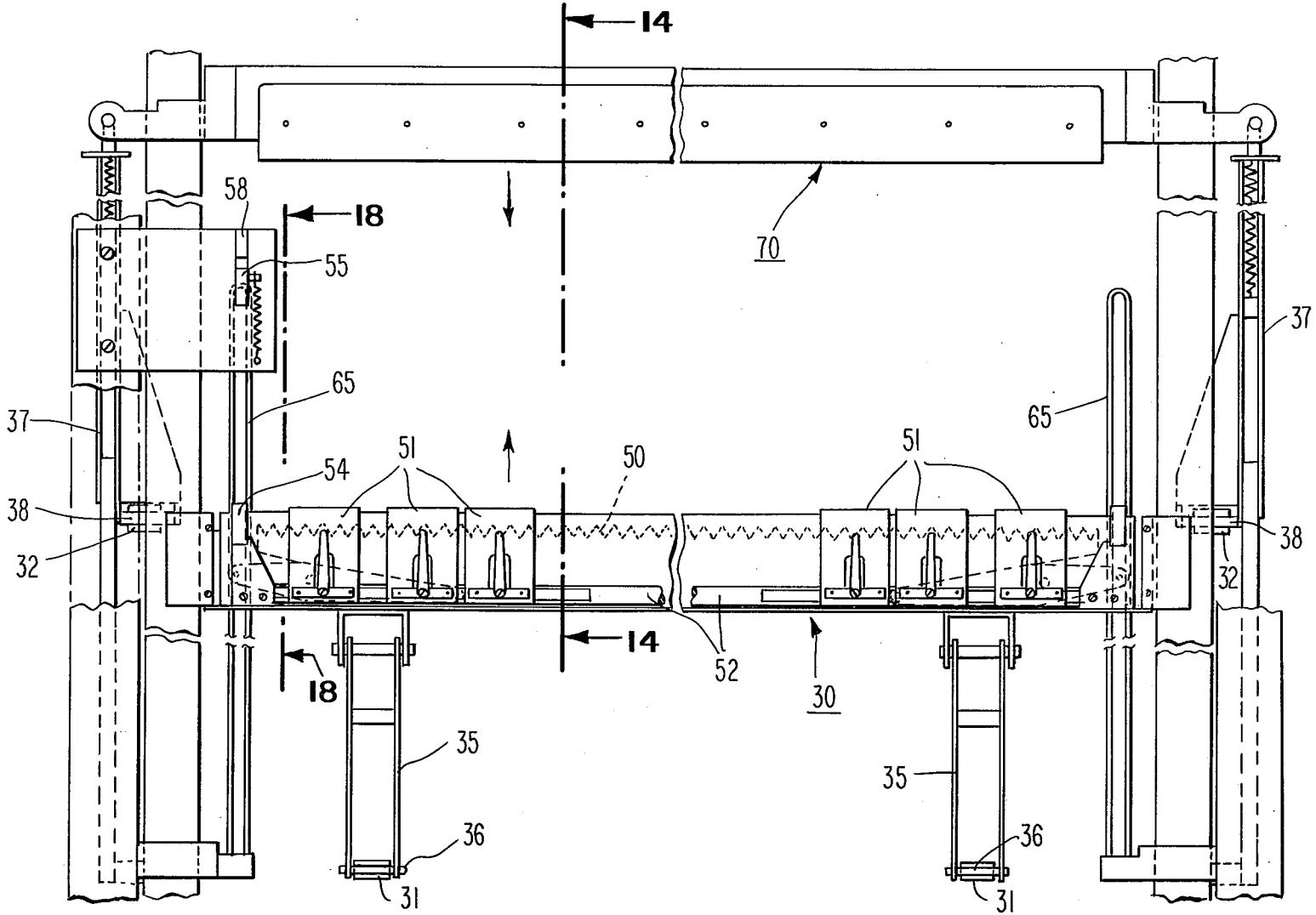
FIG. 13 is a front elevational view looking forwardly (in the direction of package travel) along the line 13—13 of FIG. 7.
Figure 14:
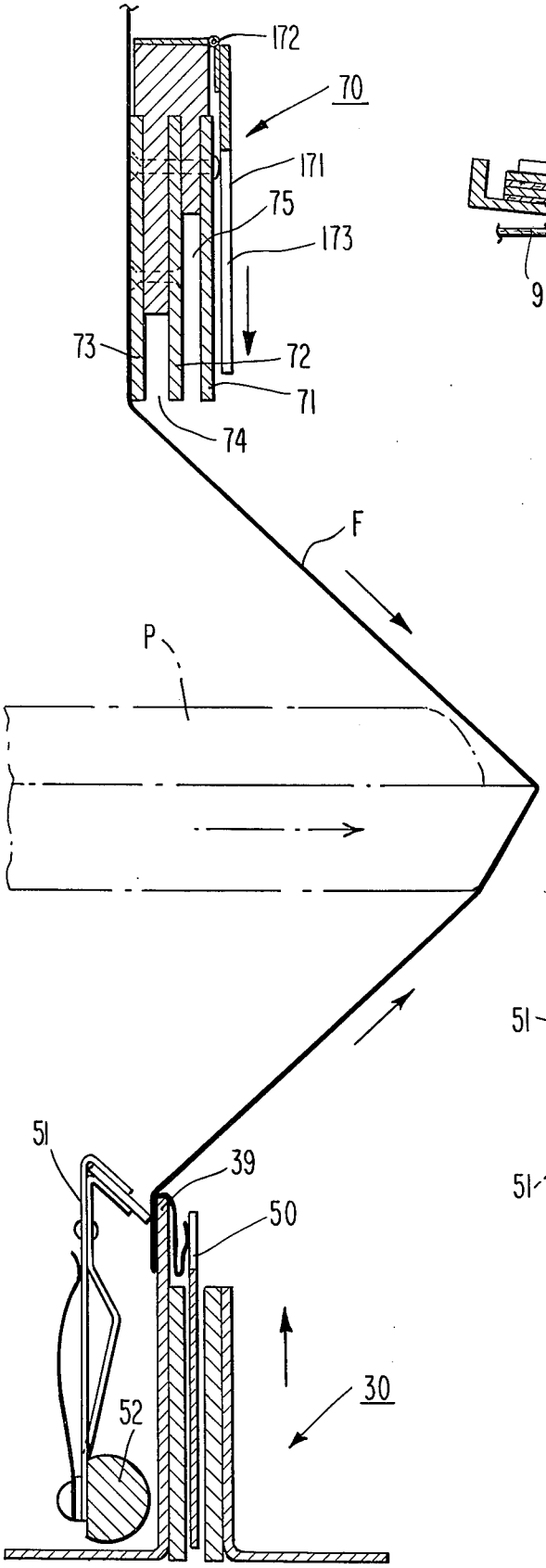
FIG. 14 is a side elevational view of the bight carrier and lap-adjuster mechanisms looking along the line 14—14 of FIG. 13.

Reference is now made to FIGS. 3 and 14. The side elevational view in FIG. 14 corresponds, so far as the time instant in the cycle is concerned, to the schematic representation in FIG. 3. That is to say, the package P is being pushed through the wall of film F, the lap adjuster 30 is rising, and the bight carrier 70 is falling. As seen in FIG. 14, the lower end of the film is gripped by spring-biased film grippers 51. There are multiple removable film grippers 51 spread across the width of the machine. Six of these grippers 51 are illustrated in FIG. 13. The grippers are mounted on a rod 52 which extends the full width of the machine. The grippers press the end of the film against the blade 39 of the lap adjuster.

Referring now to FIGS. 4, 13, 15, 18 and 19, mounted on rod 52 at one side of the machine, (the left side as viewed in FIG. 13) is a toggle mechanism identified generally by the reference numeral 53. When the lap-adjuster mechanism 30 approaches the upper limit of its stroke, the cam-link element 54 (FIG. 18) which projects rearwardly from the toggle mechanism 53 encounters the spring-loaded dog 55, as illustrated in phantom. As lap adjuster 30 continues its upward movement, the cam link 54 is cammed downwardly, thereby breaking the toggle and raising the movable pivot pin 56 of the toggle mechanism 53 from the straightened position shown in solid line in FIG. 18 to the broken position shown in phantom. This action rotates rod 52 counter-clockwise, and pulls the film grippers 51 away from the blade 39 (FIG. 14) of the lap-adjuster mechanism, thereby releasing the end of the film. As upward movement of the lap adjuster continues, the cam link 54 clears the spring-loaded dog 55 and grippers 51 remain open. As the bight carrier 70 approaches the lowermost limit of its downward movement, the undersurface 57 of an adjustable arm 58 encounters the toggle mechanism 53, at the pivot 56, thereby returning the toggle mechanism from the broken position shown in phantom in FIG. 18 to the straightened position shown in solid lines in FIG. 19. This rotates rod 52 clockwise and returns the film grippers 51 from their open film-released positions to their closed film-gripping positions. These grippers 51 now grip the new lower end of the film from which a piece has been severed. The severed piece has, of course, been used to envelop the package P.

Figure 15:
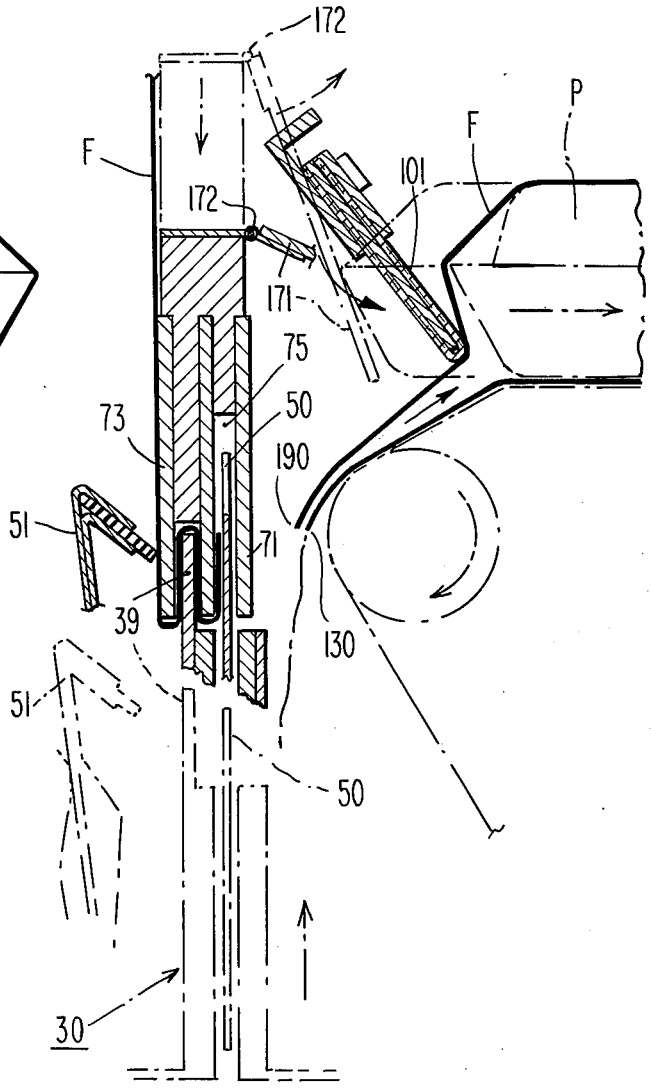
FIG. 15 is a detailed view illustrating the intermeshing of the bight carrier and lap-adjuster mechanisms and the shear blade.

As previously indicated, severing of the piece of film which has been looped about the package P is accomplished by the shear blade 50 seen in FIG. 13 and in side elevation in FIGS. 14 and 15. A front view of a portion of the blade 50 is also seen in FIG. 17 together with the mechanism which lifts blade 50 to its cutting position, shown in phantom in FIG. 17.

Referring now to FIGS. 13, 14, 15 and 17, as the lap adjuster 30 rises toward the level of the package path, it carries with it shear blade 50. The end portion of blade 50 is seen in FIG. 17. Pinned to lap adjuster 30 by a pivot pin 61 is a pair of pivot plates 62, one plate on each side of the blade 50. A pin 63 in blade 50 projects in both direction from the blade into elongated slots in the pivot plates 62. The one end of each of the pivot plates 62 (the right end as viewed in FIG. 17) is pinned to a slide member 64 which is adapted to slide upwardly and downwardly in the wire-loop member 65. When the lap adjuster 30 reaches the upper limit of its travel, the slide member 64 will reach the upper limit of the wire loop 65, and as the bight carrier 70 approaches its lowermost limit, the pair of pivot plates 62 wil be caused to pivot about the pin 61, thereby lifting the shear blade 50 from the solid line position, to the phantom position illustrated in FIG. 17.

Reference is now made to FIGS. 14 and 15 which illustrate schematically the action taking place when lap adjuster 30 at the top of its upward stroke meets and meshes with the bight carrier 70 at the bottom of its downward stroke. It will be seen that as the blades of the lap adjuster begin to intermesh with the blades of the bight carrier, the upwardly extending micarta blade 39 of the lap adjuster enters into the groove 74 between the downwardly extending micarta blades 73,72 of the bight carrier, and, an instant later, the shear blade 50 enters into groove 75 between micarta blades 72 and 71. This action first pushes the film up and around the upper end of micarta blade 39, and, an instant later, shear blade 50 enters groove 75, pushes the film upwardly, and then severs the film, as illustrated in FIG. 15. The severed end is identified in FIG. 15 by reference numeral 190. The end of the film which was released by the film grippers 51 is identified by reference numeral 130. The phantom line which extends downwardly from end 130 indicates the initial position of the released film end after it was released and before the package was pushed to the position illustrated in FIG. 15.

Figure 16:
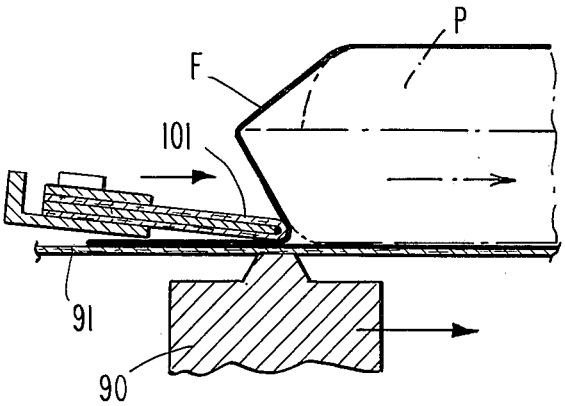
FIG. 16 is a detailed view showing the cross-seal heater and transport cross-flight.

Referring now to FIGS. 15 and 16, after the film has been severed at 190 the package P is enveloped in a severed tubular loop of film having upper and lower trailing portions which occupy overlapping positions and which extend from the rear edge of the package to the ends 190 and 130. The first transport 100 is, of course, running, in a counter-clockwise direction as viewed in the drawings. As one of the cross flights 101 approaches the rearward edge of the package P, it engages the upper portion of the film loop at the rearward end of the package, as illustrated in FIG. 15. As counter-clockwise movement of transport 100 continues, the cross flight 101 assumes the position shown in FIG. 16. In that position, it pushes the upper portion of the film loop down against the lower portion of the film loop at the rearward edge of the package. At this time, the cross-seal heater 90, whose path of movement is that of a parallelogram, rises and engages the undersurface of the cross-seal belt 91, and heat is transferred to the film at the trailing or lap portions thereof. As the package P continues its forward direction (to the right as viewed in FIG. 16) the cross-seal heater 90 likewise moves to the right, and at the same speed as the package. In this manner, heat sealing of the trailing or lap portion is effected.

Figure 8:
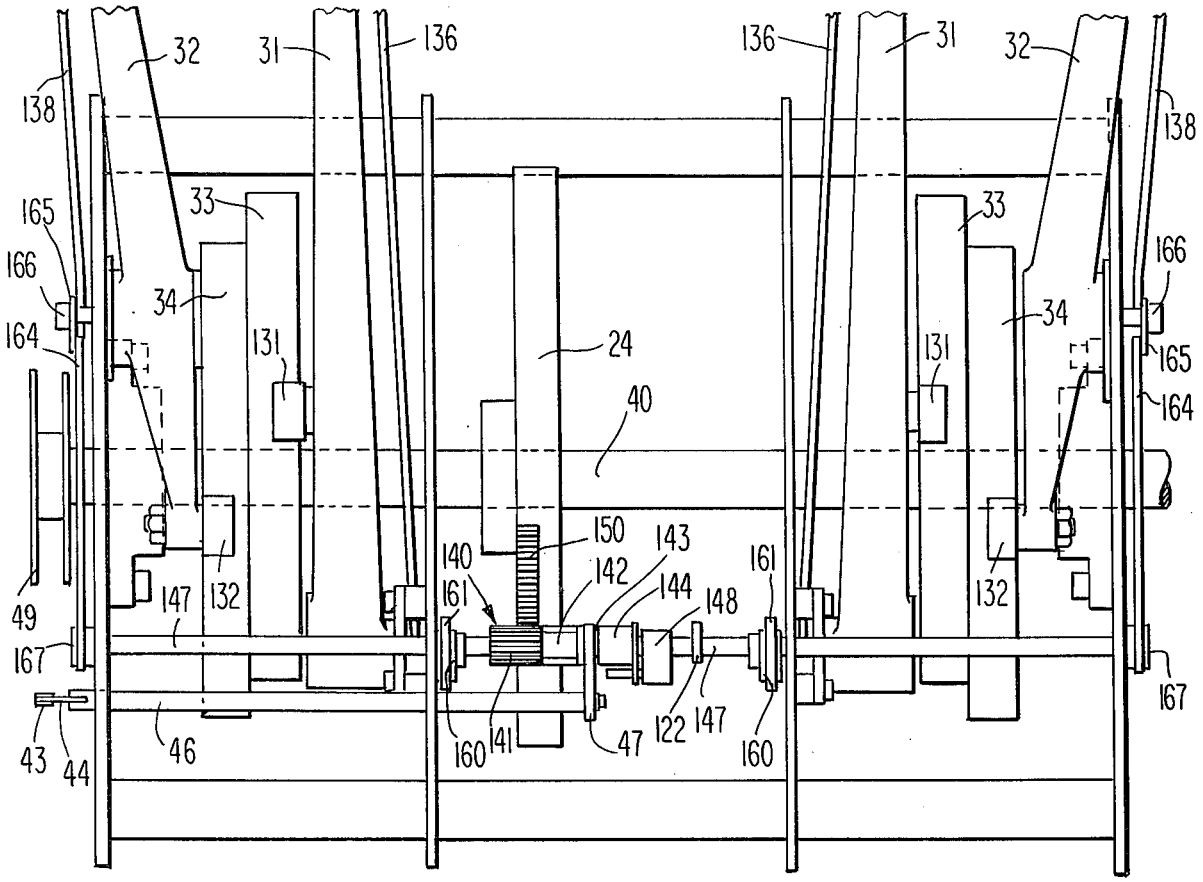
FIG. 8 is a plan view of the cam shaft, eccentric, and shift mechanisms, looking down along the line 8—8 of FIG. 7.
Figure 11:
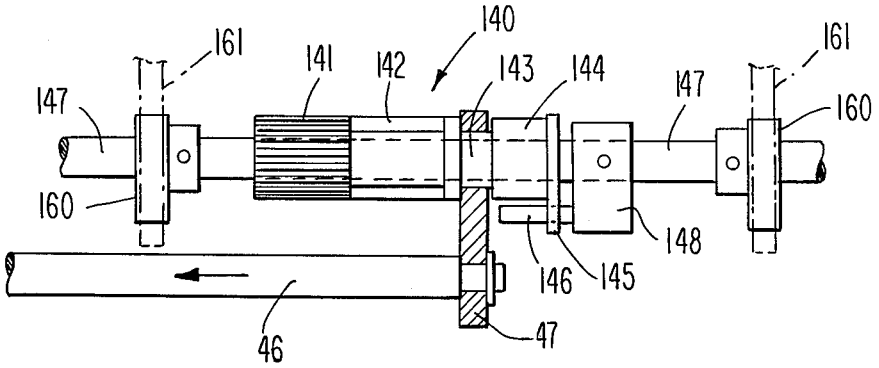
FIG. 11 is a detailed view of the shift mechanism.
Figure 12:
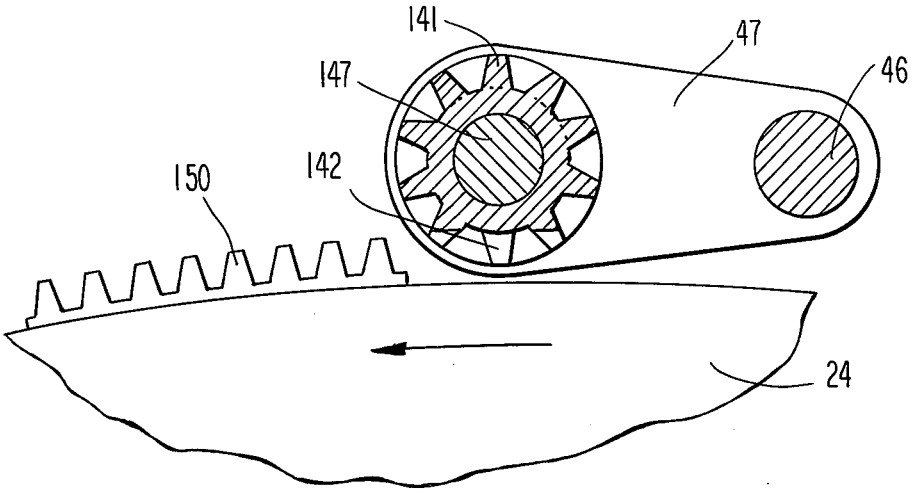
FIG. 12 is a view of the modified pinion and gear-segment mechanisms, looking along the line 12—12 of FIG. 9.

The means by which the cam follower arms 31 and 32, which drive the lap adjuster and bight carrier, respectively, are connected to the connecting links 35 and 37 will now be described. Although not shown in the drawing, similar means are used to connect an in-feed cam follower arm to an in-feed connecting link. When a package is placed on the package sensor switch 21, an electrical circuit is closed, either instantly or a moment later, according to the condition of the timing switch 48 (FIG. 7) controlled by a cam 49 on cam shaft 40. When the circuit closes, solenoid 42 (FIGS. 7 and 9) is energized. This pulls down the plunger 43 and, as seen in FIG. 9, a bell crank 44 is pivoted about pivot point 45. This pulls rod 46 to the left, as viewed in FIGS. 8 and 9, and when rod 46 moves to the left, it pulls to the left a bracket 47. This movement of bracket 47 shifts to the left a modified-pinion member 140 which consists of a number of integral parts identified 141, 142, 143, 144, 145. These pinion parts are seen in FIGS. 8 and 9 and in enlarged detail in FIGS. 11 and 12. Parts 143–145 have no teeth. Each of the parts 141 and 142 is a pinion segment with a few teeth modified, i.e., cut away along the line generated by the crown of the teeth of gear segment 150, seen in FIG. 12. In FIG. 12, which is a view cut through pinion 141, looking to the right in FIG. 11, three lower teeth are shown modified. Pinion 142 has corresponding teeth modified, but the modified teeth in pinion 142 are on the upper side of the pinion 142, as viewed in FIGS. 11 and 12. Integral with the modified pinions 141 and 142 is part 144 connected to 142 by a portion 143 of reduced diameter which passes through a hole in bracket 47. None of the integral parts forming member 140 is pinned or otherwise secured to shaft 147 on which 140 is mounted. Thus, the pinions 141, 142 are adapted to be shifted axially relative to the shaft 147. The right end of part 144 has an enlarged portion 145 having therein a hole which snugly receives a pin 146 which projects axially, to the left as viewed in FIG. 11, from a member 148 which is pinned to shaft 147. Thus, while the pinions 141 and 142 are adapted to be shifted axially relative to the shaft 147, these pinions can not be moved rotationally relative to the shaft 147. Rotation of the pinions 141 and 142 will, through pin 146 and member 148 cause rotation of the shaft 147. Similarily, rotation of the shaft 147 will cause rotational movement of the pinions 141 and 142.

Referring now to FIGS. 8 and 9, as well as to FIG. 12, positioned below the modified pinion member 140, as viewed in FIGS. 8 and 9, is a gear segment 150 which is mounted on and secured to the in-feed cam 24. It will be seen, from an examination of FIG. 9, that when the modified-pinion member is in the position illustrated in FIGS. 8 and 9, rotation of the in-feed cam 24 will not rotate the modified pinion member 140 since the teeth on the gear segment 150 move through the underside of pinion part 141 which is lacking teeth. If, however, member 140 is shifted to the left, as viewed in FIGS. 8 and 9, the teeth on the underside of pinion 142 will be placed in the path of the gear segment 150 so that when the gear segment 150 arrives at the location of the member 140 engagement will take place and the member 140 will be rotated, but only through 180°, since rotation of 180° will bring to the lower position that portion of pinion 142 which is without teeth. Thus, on the succeeding rotation of the in-feed cam 24, the teeth of the gear segment 150 will not mesh with the teeth of the pinion 142, which are now in the upper position.

It will be seen that the means just described are effective to cause rotation of the shaft 147 through 180° when rod 46 is shifted axially. As previously described, shifting of rod 46 in the axial direction to the left as viewed in FIGS. 8 and 9, is achieved when the solenoid 42 is energized to pull down plunger 43 and to rotate bell crank 44 about the pivot 45. The function of the previously referred to cam-operated timing switch 48 will now be clear. Its function is to prevent solenoid 42 from being energized at that instant in the timing cycle when the gear segment 150 is in the path of the teeth of the pinion member 140. Shifting of rod 46 at this time is avoided by switch 48 which is open.

Rotation of shaft 147 through 180°, as described above, is effective to cause connection of the cam-follower arms 31 and 32 to the connecting links 35 and 37 of the lap adjuster and bight carrier, respectively. The time period in the cycle when this connection occurs is controlled by the cams 33 and 34, and occurs during dwells on the cams. As previously mentioned, this connection takes place when the lap adjuster 30 and bight carrier 70 are together in the intermeshed relationship illustrated in FIG. 15.

Rotation of shaft 147 is also effective to cause connection of the in-feed cam follower arm to the in-feed connecting link.

Figure 10:
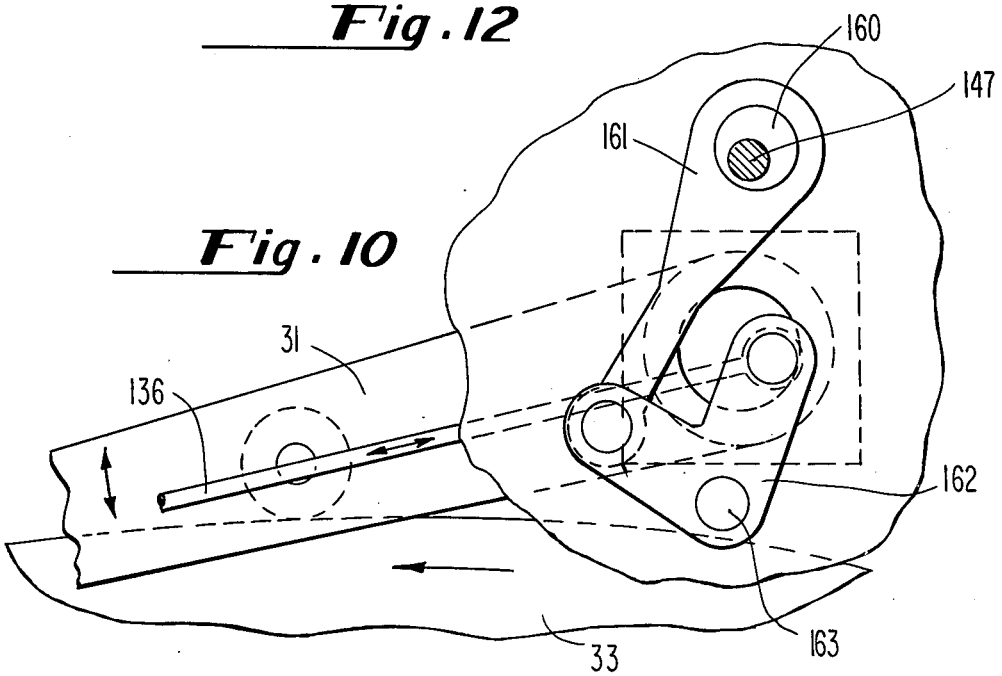
FIG. 10 is a detailed view of the eccentric mechanism, looking along the line 10—10 of FIG. 9.

The means by which 180° rotation of shaft 147 is effective to achieve connection of the cam-follower arms 31 and 32 to the lap-adjuster and bight carrier mechanisms respectively will now be described. Mounted at each end of shaft 147, as viewed in FIG. 8, is an eccentric 167. One of these eccentrics is seen in FIG. 7. Also mounted on shaft 147, at interior points, as seen in FIG. 8, are a pair of eccentrics 160. One eccentric 160 is shown in enlarged detail in FIG. 10. As shown in FIG. 10, eccentric 160 drives a link 161 which is connected at its distal end to a bell crank 162 which is pivotal about fixed pivot point 163, thereby, to drive the linkage 136 previously referred to and shown in FIG. 7. Also mounted on shaft 147 is eccentric 122 which operates in a similar manner to that described herein for eccentrics 160 and 167. Eccentric 122 is associated with the in-feed mechanism and controls connection of a follower arm (not shown) to in-feed lever 22. The follower arm referred to is driven by in-feed cam 24.

Referring now to FIG. 13, it will be seen that linkage 35 consists of a pair of plates which carries at its forward end pin 36. Linkage 35 is movable by linkage 136 into and out of the notch at the bifurcated end of follower arm 31. Thus, when pinion shaft 147 is rotated through 180° by means of gear segment 150, the eccentric 160 is moved into a position illustrated in FIG. 10. In moving into this position, the eccentric link member 161 pulls the bell crank 162 rotationally in a clockwise direction about the pivot pin 163, thereby pulling the lap-adjuster linkage 136 toward the right, as viewed in FIGS. 7 and 10. This has the effect of pulling the pin 36 into the notch in the bifurcated end of follower arm 131, thereby connecting the follower arm 31 to the linkage 35 of the lap-adjuster. As previously mentioned, this connection takes place when the lap-adjuster is in its UP position, and not when it is in the DOWN position shown in FIG. 7.

In similar manner, as seen in FIG. 7, rotation of the eccentric 167 pulls linkage 164 to the right thereby rotating the crank 165 counter-clockwise about the pivot point 166, thereby pulling the bight-carrier linkage 138 to the right, thereby pulling the linkage 37 to the right, and thereby pulling pin 38 into the notch in follower arm 32. As previously mentioned, this connection takes place when the bight carrier is in its DOWN position, and not when it is in the UP position illustrated in FIG. 7.

As the cam shaft 40 continues to rotate, the follower arm 31 is driven downwardly, and the arm 32 upwardly, to the positions illustrated in FIG. 7, thereby pulling the lap-adjuster downwardly and the bight-carrier upwardly, to the positions shown in FIG. 4.

In a manner similar to that described above, eccentric 122 on shaft 147 is effective to pull a linkage and its pin into a notch at the end of an in-feed cam follower arm.

Reference is now made to FIGS. 7 and 20 and to the socalled demand film feed feature. According to this feature, film is fed positively from the film supply S in response to means which senses the need for film as dictated by the length and size of the package to be wrapped. The means by which this is achieved include two switches 88 and 41 seen in FIG. 7 and also seen in the electrical circuit of FIG. 20. The one switch, the tension-arm switch 88, is switched from one position to another by pivotal movement of the tension-sensing arms 84 which carry the tension-sensing roll 85. Assume, for purposes of discussion, that the switch arm of switch 88 swings to contact '*b*' (FIG. 20) when the tension arms 84 swing to the left of vertical, as viewed in FIG. 7. If the switch arm of cam switch 41 is also at contact '*b*', the circuit to the clutch brake 180 will be broken, the circuit to the drive clutch 86 will be completed, and the pull-off roll 82 will be driven to provide additional film until arms 84 swing back to the right of vertical, at which time the electrical circuit to the drive clutch 86 will be broken by movement of the switch arm of switch 88 to contact '*a*', thereby energizing the brake 180. The function of cam switch 41 is to prevent additional film from being fed from the supply roll S when, as in FIG. 1, the film is pulled down by the lap-adjuster to form a wall W of film for the package which has just been placed on the in-feed switch 21.

Reference is again made to FIGS. 14 and 15. It has previously been described that the fingers 23 of the package-pusher push the package into the wall of film and beyond the original wall line and that during at least the latter portion of this action the bight carrier 70 and lap adjuster 30 are moving toward the package path, thereby, to form the upper and lower portions of a tubular loop of film which is being formed about the package. It has also been described that the pusher 23 arrives at the location of the original wall of film just before the lap adjuster and bight carrier arrive and intermesh together. The action occurring will now be described in somewhat greater detail.

Shortly before the lap adjuster and bight carrier arrive at the level of the package path, the pusher fingers 23 push the package to a position forward of the original line of the film wall. Such a position is shown in phantom in FIG. 15. The fingers are then withdrawn behind the original line of the wall of film before the bight carrier and lap adjuster meet and intermesh. During the brief moment of time following withdrawal of the pusher fingers and before the rear edge of the package is engaged by a cross flight 101 of the transport 100, the article would back up due to the rearward force applied to the front edge of the package by the film which is under tension. To prevent such back up, anti-back-up means are provided in the form of a plate 171 seen in FIGS. 14 and 15. This plate 171 is pivotally mounted on bight carrier 70 by a hinge 172. For reasons to be explained, the anti-back-up plate 171 is slotted at two places corresponding to the locations of the pusher fingers 23. One of these slots 173 is indicated in FIG. 14.

Plate 171 normally hangs straight downwardly, as indicated in FIG. 14. However, as the downwardly-moving bight carrier 70 approaches the level of the package path, plate 173 is engaged by a fixed cam (not shown). This cams plate 171 forwardly, to the right as seen in FIG. 15, to a position indicated in phantom. Here it engages the rearward edge of the package P shown in phantom in FIG. 15. Because of the slots 173 in the plate, plate 171 is able to move to the position shown in phantom in FIG. 15 before the pusher fingers 23 have been withdrawn. As the bight carrier continues its downward movement to its final intermeshing position, the plate 171 is cammed forwardly to a greater angle. This is indicated in solid line in FIG. 15 where only a short portion of plate 171, near hinge 172, is shown. In its fully extended position, the anti-back-up plate 171 bears against the lower rear edge of the package, preventing its rearward movement, until the package is engaged by the cross flight 101 of the transport 100. When the bight carrier 70 later returns upwardly, the anti-back-up plate 171 encounters a bar fixed to the frame. This causes the plate 171 to drop pivotally downwardly to the position shown in FIG. 14.

In this specification reference has been but briefly made to the second transport mechanism identified 110, having a plurality of pushers 111 which overlap the pushers 101 of the first transport 100 and continue to push the article forward along a straight horizontal in-line path. This mechanism 110 may be substantially similar to that described in U.S. Pat. Nos. 3,629,993 and 3,748,825, issued to Albert H. Chant, Jr. and assigned to and owned by the assignee of the present application. The Chant patents describe in detail the means by which the open ends which project from either side of the tubularly-wrapped package are pre-stretched, stretched, folded onto the underside of the package, and then heat sealed.

In FIGS. 1–6, reference numeral 112 identifies a pair of gripper chains, one pair on each side of the machine. A pre-stretch belt (not shown) may precede the gripper chains. The function of the gripper chains 112 is to grip the ends of the tubular wrap and pull them downwardly and forwardly. Guides not shown then fold the tightly stretched ends under the package. The package is pushed by transport pushers 111 and heat sealed by bottom heaters (not shown) while pressure is maintained by belt 120. Pressure belt 120 is optional. In some versions, the package is passed through a shrink tunnel to shrink the film about the article. In such shrink-tunnel version, pre-stretching and down-stretching of the tubular ends is not necessary and gripper chains 112 are not needed.

Reference is now made to FIG. 20, which is a schematic of pertinent portions of the electrical control system of the new machine. In FIG. 20, the starting switch 181 is shown in its open position; the multi-contact film-feed switch 188 is also shown in open position; the package sensing switch 21 is shown in the position which it assumes when there is no package at the in-feed position; the cam-actuated film-feed timing switch 41 is shown in the position which it assumes after a package has been sensed and is being pushed forwardly toward the curtain of film; the tension arm film-sensing switch 88 is shown in the position which it assumes when the sensing-roll support rods 84 are to the right of vertical, as viewed in FIGS. 1–6, indicating that no additional film is required; the cam-operated demand timing switch 48 is shown in the position it assumes during most of the operating cycle; and the contacts for the various relays, identified CR1, CR2A, CR2B and CR3, are shown in the conditions which they assume when their respective relays are not energized.

The operation of the electrical systems shown in FIG. 20 will now be briefly described. To turn the machine on, the film-feed switch 188 and the start switch 181 are both closed. This energizes the primary winding of transformer 184 and provides a 110-volt AC power to the DC power supply which furnishes DC current to the film supply arbor brake and to the clutch which controls the drive to the film pull-off roll 82. Whether or not current is supplied to the clutch or to the brake is dependent upon the conditions of switches 88 and 41. It will be seen that to supply the current to the clutch, both of the switches 88 and 41 must be closed to the '*b*' contacts.

Consider now what happens when a package is placed at the in-feed position and is sensed by the sensor switch 21. When this happens, the arm of switch 21 moves from contact '*a*' to contact '*b*'. With the arm of the cam-operated timing switch 48 in the position shown in the drawing, a circuit is completed through the closed contacts of the relay CR1. Thus, relay CR2A and CR2B become energized. As a result, the contacts '*a*' and '*b*' of relay CR2A close, contact '*a*' of relay CR2B closes, and contact '*b*' of relay CR2B opens. The closing of the contacts '*a*' of relay CR2B energizes the solenoid 42 and by the means already described, the rod 46 is shifted. The purpose of the cam-operated timing switch 48 is to prevent the energizing of the solenoid 42 and the shifting of the pinion member 140 during that period of the cycle during which the gear segment 150 is in contact with, or is in a position to be contacted by, the teeth of the pinions of member 140. During this portion of the cycle, the arm of switch 48 is cammed over to the contact '*b*' position. Thus, during this time interval, if a package is placed and sensed by the switch 21, the resulting movement of arm of switch 21 from the '*a*' to the '*b*' position does not complete a circuit and the relays CR2A and CR2B are not energized until the arm of switch 48 is cammed back to the '*a*' position.

Consider now what happens when in response to sensing a package at the in-feed position, the lap adjuster 30 is moved downwardly from its upper to its lower limit position, thereby pulling down the film and moving the film sensing-roll supporting bars 84 to a position to the left of vertical, thereby moving the arm of switch 88 from contact '*a*' to contact '*b*'. However, during this portion of the cycle, the arm of the film-feed timing switch 41 is not in the '*b*' position shown in the drawing; rather it is in its upper position making contact with contact '*a*'. Thus, when the arm of switch 88 moves to the contact '*b*' position as a result of the lap adjuster pulling down the film, the clutch is not energized and the brake continues to be energized. During the subsequent period when the lap adjuster is rising toward the level of the package path and a tubular loop of film is being formed about the package, if the sensing-roll support bars 84 should be moved to the left of vertical, thereby moving the arm of switch 88 from the '*a*' to the '*b*' position, it will find the arm of switch 41 also in the '*b*' position, and the brake will be deenergized and the clutch energized, thereby driving the film pull-off roll 82 and providing additional film for the wrapping of the package.

In view of the foregoing detailed descriptions of the more important components of the machine of the present application, the following summarization of its features will be more readily understood:

The articles are wrapped in film as they move through the machine on a single level. The articles may move in a continuous flow but each package triggers one cycle of operation of the machine. The film supply is on rolls held by a turret 81. The film rolls are loaded at the lowermost position of the turret. The roll in use is rotated to the position illustrated by roll S in the drawings. The film is fed by a feed system which includes an electric brake 180 on the arbor of the supply roll. A film tension-sensing roll 85 controls a switch which controls electrically a drive clutch 86 on a film pull-off roll 82. The film path is from the supply roll S, over the pull-off roll 82, around the tensioning roll 85, over a stationary guide roll 87, to the lap-adjuster 30 where the end is held by the grippers 51.

In operation, when a package is placed on the in-feed switch, the film is pulled vertically down across the package path by the lap adjuster 30, and, as the package is advanced by the in-feed pushers 23, the film end rises to provide a constant bottom lap regardless of the package length. As the in-feed pushers 23 move the package beyond the initial position of the curtain or wall of film, the film is wrapped around the package, top and bottom. The bight carrier 70 moves down behind the package forming a bight of film which is gripped by the lap adjuster 30 and sheared along a line located between the grippers and the package. At this time, one cross flight 101 of the first transport 100 has come down behind the package and has clamped the two trailing film ends together against the belt 91 of the cross seal heater 90. As the package advances, the heater bar of cross seal heater 90 rises and travels with the cross flight 101 to heat seal the two trailing film ends, thereby forming an open ended tubular wrap. The open ends are closed by guides (not shown) and are pulled tight by a pre-stretch belt (not shown) then stretched tight by the stretch chains 112, and folded under the package by a guide (not shown). The package is pushed by pusher 111 of the second transport 110 along the main seal heaters, with down pressure being maintained by the belt 120.

When the machine is turned on, the heaters will be operative. Closing the start switch will start the transports 100 and 110. The in-feed 20, the lap-adjuster 30 and the bight carrier 70 operate only "on demand" when a package is placed on the in-feed 20. After starting the machine, if no package is placed on the in-feed, the transports 100 and 110 will time out and stop after a preset interval controlled by timer 185 unless overridden. The heaters, however, remain ON. The machine also includes package guides (not shown) which are power adjustable to the package width. The operating speed is also adjustable; so are the sealing temperatures.

The common cam shaft 40 makes one revolution per machine cycle. This cam shaft actuates the in-feed 20, bight carrier 70, and lap-adjuster 30 mechanisms. When there is no package on the in-feed switch 21, the three mechanisms are stopped in specific positions. The in-feed 20 is stopped at the start position. The bight carrier 70 is stopped in its down position. The lap-adjuster 30 is stopped in its up position. The cam shaft 40 runs continuously, as do the cam follower arms. The cam cycles have dwells of varying amounts and locations. During these dwells, if there is no demand, i.e., no package, the pins at the ends of the follower arms are moved from engagement with the follower arms to engagement with a fixed stop. On demand, the pins are moved into the follower arms. This movement is accomplished by a linkage system operating through the arm pivot centers to an eccentric shaft 147. This shaft 147 rotates 180° during the dwell to shift in either direction. This motion is accomplished by a gear segment 150 on the in-feed cam 24 and a modified pinion member 140 on the eccentric shaft 147. The pinion member 140 is shifted axially on signal at any time in the cycle except during the dwell. The shifting is accomplished in the "demand" direction by energizing solenoid 42 and in the "no demand" direction by a biasing spring, not shown. The solenoid 42 is controlled by a relay CR2B which receives its signal from the package switch 21 through a cam operated switch 48 on the cam shaft which is open during the dwell.

The shear blade 50 and the grippers 51 are mounted on the lap adjuster 30 and ride up and down with it. As the package moves in, the lap adjuster 30 moves up adjusting the film length to suit the length of the package. About an inch before it reaches the top of its travel, the grippers 51 are released by action of a spring-loaded dog 55 which breaks the toggle 53 and releases the film end so that the film end 130 can move with the package. The lap adjuster moves to its topmost position and stops with the grippers 51 open. The bight carrier 70 moves down carrying the film down behind the package and engages in intermeshing relationship with the lap adjuster 30. By means of the linkage 62, the shear blade 50 moves up between the micarta blades of the bight carrier and severs the film. At the same time, the grippers 51 are closed by action of the toggle 53 which is straightened and locked. The bight carrier 70 and lap adjuster 30 then remain in their intermeshed position until the next package is signaled.

The following is a summary of the electrical circuitry and its functions:

When a package is placed on the in-feed platform, the package sensor switch 21 moves to contact '*b*' and the demand solenoid 42 is energized through the relays CR2A and CR2B except when the roller of the demand timing switch 48 is on the flat of its cam allowing the arm of 48 to move to contact '*b*'. The latter is the condition during the dwell period.

When the demand solenoid 42 is energized, it shifts the pinion member 140 to operate the in-feed pusher, the bight carrier and the lap adjuster. The demand solenoid 42 remains energized during consecutive cycles provided a succeeding package is placed on the package sensor platform before the roller of demand timing switch 48 switches to the flat of its timing cam.

The function of relay CR1 is to de-energize the demand solenoid 42 when there is no package on the package sensor and the demand timing switch roller is on the flat of its timing cam.

The function of the tension-arm switch 88 is to energize the arbor brake and prevent the film arbor from rotating when the tension roll arms 44 are to the right of vertical as viewed in the drawing. When the film tension roll arms 84 are pulled to the left of vertical, as they are when film is demanded, the tension switch arm 88 switches from contact '*a*' to contact '*b*', thereby releasing the arbor brake 180 and energizing the drive clutch 86 of the pulloff roller 82. The function of clutch 86 is to engage the pull-off roller 82 with a drive chain not shown.

At the start of each cycle, the film feed timing switch 41 changes from contact '*b*' to contact '*a*', the switch roller being then on the flat of the timing cam. With the timing switch 41 at contact '*a*', the drive clutch 86 cannot be energized. This is the condition which exists during the down stroke of the lap adjuster. It keeps the film arbor brake 180 energized as the tension arms 84 move to the left of vertical. This keeps tension on the film web during the lap adjuster DOWN stroke. The film timing switch 41 changes from '*a*' to '*b*' during the lap adjuster UP stroke. This releases the film arbor brake 180 and allows the drive clutch 86 to be energized.

The function of the film feed switch 188, in the OFF position shown in FIG. 20, is to cut off power to both the brake and the clutch, so that both the film arbor and the pull-off roller are free to rotate when threading the film. Switch 188 also prevents the machine from being started if the start switch 181 is pressed during film threading. In the ON position of switch 188, either the brake or the clutch may be energized and the machine will start by pressing the start button 181.

What is claimed is:

1. Apparatus for wrapping an article in thin-gage heat-sealable film comprising:

a. means for pushing against the rearward edge of said article to push said article from a first position forwardly along a horizontal path into a continuous seamless substantially vertical curtain of film supplied from a single supply roll;

b. means for assisting in forming a continuous seamless tubular loop of film about the article as the article is moved forwardly into the film beyond the original location of the curtain, said loop being open at the rearward edge of the article;

c. means for providing a preselected fixed length of overlapping tail film trailing behind the rearward edge of the article irrespective of the size of the particular article being packaged, said means including film-end holding means for holding the end of the film curtain at a fixed limit position located a preselected fixed distance away from the horizontal package path, said distance having a preselected fixed relationship to the distance from the original curtain position to the article pushing means when at its start position;

d. means for moving said film-end holding means toward said article path during the movement of said article pushing means, including means for causing the film-end holding means to start moving from its fixed limit position toward the package path at a time and at a rate of travel that has a predetermined fixed relationship to the starting time and rate of travel of the article pushing means, whereby the film-end holding means arrives at the level of the package path at a time which is fixed relative to the time of arrival of the article pushing means at the original curtain position, whereby a trailing tail of film of preselected fixed length is formed irrespective of the length of the package.

2. Apparatus according to claim 1 wherein means are provided for pushing the sealed tails forwardly against or under the underside of the package while continuing to move the package forwardly along said horizontal path.

3. Apparatus according to claim 1 wherein means are provided for sensing the need for additional film to form the upper portion of the loop.

4. Apparatus according to claim 3 wherein said means are provided for sensing the need for additional film to form the upper portion of the loop is responsive to the tension on the film.

5. Apparatus according to claim 4 wherein:

a. a powered film-feed drive is provided;

b. said means for sensing the need for additional film to form the upper portion of the loop includes electrical switch means adapted to control said powered film-feed drive.

6. Apparatus according to claim 3 wherein sensing means are provided for sensing the presence or absence of an article at the first position.

7. Apparatus according to claim 6 wherein:

a. a source of supply to said film is provided at a location substantially above the package path;

b. said film-end holding means includes;

b1. means, effective in the absence of sensing an article at the start position, for holding the end of the film at the level of the package path;

b2. means, responsive to sensing an article at the first position, for actuating said film-end holding means to cause said holding means to descend from the level of said package path to its lower limit position and thereafter to rise to the level of the package path to complete the cycle.

8. Apparatus according to claim 7 wherein:

a. film loop-forming means is provided which, in the absence of sensing an article at the first position, is in mesh with said film-end holding means at the level of the package path.

b. said means responsive to sensing an article at the first position includes means effective to actuate said loop-forming means to raise said means to an upper limit position and for thereafter lowering said loop-forming means during the rising of said film-end holding means.

9. Apparatus according to claim 8 wherein said means responsive to sensing an article at the first position includes means effective to actuate said article-pushing means.

10. Apparatus according to claim 9 wherein said film-end holding means and said loop-forming means intermesh at the level of the package path at the conclusion of the rising stroke of said film-end holding means and the lowering stroke of said loop-forming means.

11. Apparatus according to claim 10 wherein said article pushing means arrives at said wall of film just before the time instant that said film-end holding means and said loop-forming means intermesh.

12. Apparatus according to claim 11 wherein said film-end holding means carries a shear blade for severing said film when said film-end holding means intermeshes with said loop-forming means at the level of the package path.

13. Apparatus according to claim 12 wherein said shear blade is adapted to sever the upper portion of the loop of film to form an upper tail trailing behind the rearward edge of the article.

14. Apparatus according to claim 13 wherein means are provided for releasing the end of film from said film-end holding means before said film is severed by said shear blade and for thereafter re-gripping the supply end of the severed film.

15. Apparatus according to claim 14 wherein means are provided for connecting said actuating means to said film-end holding means and for connecting said actuating means to said film loop-forming means when said film-end holding means and said loop-forming means are in intermeshed position at the level of the package path.

16. Apparatus according to claim 15 wherein said means for connecting said actuating means is responsive to said sensing means, said connecting means being effective to connect said actuating means only in response to a signal from said sensing means that an article has been placed at the first position.

17. Apparatus according to claim 16 wherein said means for connecting said actuating means includes:

a. a shift mechanism.

b. a solenoid responsive to said article sensing means for actuating said shift mechanism.

18. Apparatus according to claim 17 wherein said shift mechanism includes:

a. a modified pinion with axially displaced teeth segments;
b. a shaft and means mounting said pinion on said shaft for angular movement therewith, said pinion being shiftable in the axial direction of said shaft;
c. a gear segment movable rotationally in a plane at right angles to said shaft;
d. means responsive to said solenoid for shifting said pinion axially on said shaft to place one or the other of said pinion teeth segments in the path of said gear segment for rotating said shaft through 180°;
e. eccentric means on said shaft;
f. linkage means for connecting said eccentric means to said film-end holding means.

19. Apparatus according to claim 18 wherein second linkage means connect second eccentric means to said loop-forming means.

20. Apparatus according to claim 19 wherein third linkage means connect third eccentric means to said article-pushing means.

21. Apparatus according to claim 20 wherein said modified pinion comprises:
a. first and second pinion halves each having a plurality of adjacent teeth removed;
b. the location of the removed teeth of said first pinion half being displaced 180° relative to the removed teeth of said second pinion half.

22. Apparatus according to claim 21 wherein cam-operated switch means are provided for inhibiting energizing of said solenoid when said gear segment is in the plane of said common pinion shaft.

23. Apparatus according to claim 1 wherein sensing means are provided for sensing the presence of an article at the first position.

24. Apparatus according to claim 23 wherein said pushing means are responsive to said article-sensing means.

25. Apparatus according to claim 11 wherein at least one of said film-end holding means and loop-forming means carries a shear blade for severing said film when said film-end holding means intermeshes with said loop-forming means at the level of the package path.

26. Apparatus according to claim 25 wherein said shear blade is adapted to sever the upper portion of the loop of film to form an upper tail trailing behind the rearward edge of the article.

27. Apparatus according to claim 26 wherein means are provided for releasing the end of film from said film-end holding means before said film is severed by said shear blade and for thereafter re-gripping the supply end of the severed film.

28. Apparatus according to claim 11 wherein:
a. said article-pushing means is adapted to push said article to a position forward of the line of the wall of film;
b. means are provided for withdrawing said article-pushing means from said forward position before said film-holding and loop-forming means intermesh;
c. anti-backup means are provided for inhibiting said article from backing up from said forward position, when said pushing means is withdrawn, in response to the rearward force exerted by said film.

29. Apparatus according to claim 28 wherein said anti-backup means is mounted on said loop-forming means.

30. Apparatus according to claim 29 wherein said anti-backup means comprises:
a. an anti-backup plate mounted pivotally on said loop-forming means;
b. cam means for camming said anti-backup plate forwardly before said loop-forming and film-end holding means intermesh.

31. Apparatus according to claim 30 wherein said anti-backup plate is provided with slots for the forward portions of said article-pushing means.

32. A method of wrapping a package in heat-sealable thin-gage film comprising the steps of:
a. providing a straight in-line horizontal support path for said package;
b. providing a substantially vertical curtain of continuous seamless film across said path, said film having a severed end off the path and a continuous seamless length extending back across the path to the supply source;
c. moving said package toward and into said curtain of film;
d. gripping the severed end of film and moving said end toward said package path at all times during the period that said package is being moved toward and into said curtain, thereby to form one portion of a tubular loop of film about the package, the forming of said loop being characterized by substantially no relative movement between the film and the package at the forward edge of the package;
e. pressing against the continuous length of film along a line located substantially at said original curtain line to assist in forming the other portion of said tubular loop of film;
f. servering the film behind the rearward edge of the package after the package has advanced beyond the original curtain line;
g. pressing the one and other portions of film together behind the package to close the loop;
h. sealing the pressed-together portions behind the package while continuing to advance the package along said in-line horizontal path.

* * * * *